US012235012B2

(12) United States Patent
Pandit et al.

(10) Patent No.: US 12,235,012 B2
(45) **Date of Patent: *Feb. 25, 2025**

(54) SOUND ATTENUATION FOR HVAC DEVICES

(71) Applicant: Trane International Inc., Davidson, NC (US)

(72) Inventors: Yogesh Pandit, Bengaluru (IN); Richard L. Jameson, Tyler, TX (US); Zubin Varghese, Bangalore (IN); John Bailey, Tyler, TX (US); Lance Lindenburg, Tyler, TX (US); Thomas Gort, Tyler, TX (US); Shiva Prasad Keralapura Basavaraju, Tyler, TX (US); Kevin Joseph Ligi, Whitehouse, TX (US); Chris Fuller, Blacksburg, VA (US); Curtis Mitchell, Manasass, VA (US)

(73) Assignee: Trane International Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/342,276

(22) Filed: Jun. 27, 2023

(65) Prior Publication Data

US 2023/0408142 A1 Dec. 21, 2023

Related U.S. Application Data

(63) Continuation of application No. 17/219,639, filed on Mar. 31, 2021, now Pat. No. 11,725,846.

(51) Int. Cl.
*F24F 13/24* (2006.01)

(52) U.S. Cl.
CPC ..... *F24F 13/24* (2013.01); *F24F 2013/242* (2013.01)

(58) Field of Classification Search
CPC ..... F24F 13/24; F24F 2013/242
See application file for complete search history.

(56) References Cited

U.S. PATENT DOCUMENTS 3,748,085 A 7/1973 Poepsel et al.
4,294,329 A * 10/1981 Rose ..... B32B 3/12 428/116

(Continued)

FOREIGN PATENT DOCUMENTS

CN 210052518 U 2/2020
WO 2022/040693 A2 2/2022

*Primary Examiner* — David J Teitelbaum
(74) *Attorney, Agent, or Firm* — Womble Bond Dickinson (US) LLP

(57) ABSTRACT

Example embodiments of the present disclosure relate to improved HVAC devices and kits for HVAC devices that improve the sound attenuation associated with the device, particularly low-frequency noise. An example embodiment includes an improved furnace including a housing with a combustion air chamber, a heat exchanger chamber, and a circulation blower chamber, wherein the combustion air chamber comprises a burner assembly and a combustion air fan, the furnace also includes a sound attenuation layer including a first acoustic metamaterial layer coupled to the combustion air chamber and tuned to attenuate sound for a first frequency band, one or more housing openings fluidly connecting the combustion air chamber to an environment outside the housing, wherein the sound attenuation layer includes a discontinuous section that aligns with one or more of the housing openings.

19 Claims, 13 Drawing Sheets

(56) References Cited

U.S. PATENT DOCUMENTS

| | | | | |
|---|---|---|---|---|
| 5,013,597 | A | 5/1991 | Kracke | |
| 5,120,214 | A * | 6/1992 | West | F23N 5/16 431/12 |
| 5,404,934 | A * | 4/1995 | Carlson | F24F 3/044 454/258 |
| 7,086,857 | B2 | 8/2006 | Lai et al. | |
| 8,770,340 | B2 | 7/2014 | Cursetjee | |
| 9,305,539 | B2 | 4/2016 | Lind et al. | |
| 9,390,702 | B2 | 7/2016 | Mathur | |
| 9,574,791 | B2 | 2/2017 | Lind et al. | |
| 9,759,447 | B1 | 9/2017 | Mathur | |
| 10,144,854 | B2 | 12/2018 | Yoon et al. | |
| 10,774,845 | B2 | 9/2020 | Mercer et al. | |
| 2009/0239429 | A1 | 9/2009 | Kipp et al. | |
| 2010/0247339 | A1 | 9/2010 | Lagemann | |
| 2019/0003737 | A1 * | 1/2019 | Hickey | F24F 13/20 |
| 2019/0108825 | A1 | 4/2019 | Acharya et al. | |

* cited by examiner

SOUND ATTENUATION FOR HVAC DEVICES

CROSS-REFERENCE TO RELATED APPLICATION(S)

This present application is a continuation of U.S. patent application Ser. No. 17/219,639 filed Mar. 31, 2021, entitled "IMPROVED SOUND ATTENUATION FOR HVAC DEVICES", the content of which is incorporated herein by reference in its entirety.

TECHNOLOGICAL FIELD

The present disclosure relates generally to an HVAC device with improved sound attenuation features and/or a kit with sound attenuation features that may be incorporated within an HVAC device.

BACKGROUND

Current HVAC systems include multiple sound producing components, which during operation emit sound at various different frequencies and magnitudes. Methods exist for attenuating these sounds, and these methods generally fall into one of two categories, active or passive sound attenuation systems, however, problems exist with the current solutions in each of these categories.

Active systems typically reduce sound by introducing destructive acoustical sound waves designed to reduce or eliminate sound at a given frequency or frequency range. These systems typically include costly additional components, and often are only designed to attenuate sound within a very narrow frequency range. Moreover, energy is typically required to operate these systems, which reduces the overall efficiency of the HVAC device.

Passive systems use materials that absorb and/or reflect the sound energy, and existing passive systems vary widely in effectiveness. These systems, which are typically used on the outer portion of an HVAC device, often add thickness or bulk to the overall device, and tend to be particularly ineffective at reducing sound at low frequencies (e.g., under 1000 Hz). In addition, these existing systems can negatively impact the underlying performance of the device. For example, the materials used in these existing systems absorb sound and convert that energy into heat as a primary sound attenuation method, which impacts the thermal property of a given surface or space and can significantly impact the performance of an HVAC designed to move thermal loads in a precise manner.

As a result, the existing solutions fail to offer an effective solution to all of the sound producing components within an HVAC device, particularly components that produce lower frequency noise.

BRIEF SUMMARY

Thus, there exists a need for an improved system and method for reducing sound generated by an HVAC device, particularly low-frequency sound, without significantly impacting or impairing the underlying functionality of the HVAC device. The attached disclosure provides various features for accomplishing these objectives either built-in to an HVAC device or via a kit, which may be added to an HVAC device, potentially an existing HVAC device.

The present disclosure thus includes, without limitation, the following example implementations.

Some example implementations provide an improved furnace comprising: a housing comprising a combustion air chamber, a heat exchanger chamber, and a circulation blower chamber, wherein the combustion air chamber comprises a burner assembly and a combustion air fan; a sound attenuation layer comprising a first acoustic metamaterial layer tuned to attenuate sound for a frequency band, wherein the sound attenuation layer is coupled to a portion of the combustion air chamber; and one or more housing openings fluidly connecting the combustion air chamber to an environment outside the housing, wherein each housing opening provides less attenuation of sound emanating from within the combustion air chamber than the housing, wherein the sound attenuation layer includes a discontinuous section that aligns with one or more of the housing openings.

In some example implementations of the furnace of any example implementation, or any combination of any preceding example implementation, the frequency band includes a range of 400 Hz to 500 Hz and the frequency of operation of at least one of the burner assembly and the combustion air fan.

In some example implementations of the furnace of any example implementation, or any combination of any preceding example implementation, the acoustic metamaterial layer further comprises a first stacked structured, wherein the first stacked structure comprises a first perforated sheet layer arranged over a spacer layer arranged over a second perforated sheet layer.

In some example implementations of the furnace of any example implementation, or any combination of any preceding example implementation, the first and second perforated sheet layers comprise plastic.

In some example implementations of the furnace of any example implementation, or any combination of any preceding example implementation, the sound attenuation layer comprises a first portion wherein the acoustic metamaterial layer comprises the first stacked structure and a second portion wherein the acoustic metamaterial layer comprises a second double stacked structure, wherein the second double stacked structure comprises a third perforated sheet layer arranged over a second spacer layer arranged over the first stacked structure.

In some example implementations of the furnace of any example implementation, or any combination of any preceding example implementation, the first, second, and third perforated sheets are each tuned to attenuate sound for the first frequency band.

In some example implementations of the furnace of any example implementation, or any combination of any preceding example implementation, at least one of the housing openings further comprises a plurality of apertures, wherein the sound attenuation layer further comprises a first set of sound attenuation protrusions located around the plurality of apertures.

In some example implementations of the furnace of any example implementation, or any combination of any preceding example implementation, the first set of sound attenuation protrusions comprise acoustic metamaterial.

In some example implementations of the furnace of any example implementation, or any combination of any preceding example implementation, the combustion air chamber comprises a front door having an enlarged region, wherein at least a portion of the acoustic metamaterial layer is coupled within the enlarged region.

Some example implementations provide a retrofit kit for reducing low frequency sound emanating from an HVAC device having a housing, the retrofit kit comprising: a plurality of sound attenuation panels, each panel comprising at least one acoustic metamaterial layer tuned to attenuate sound for a first frequency band; and a replacement cover configured to replace an existing panel of the housing of the HVAC device, wherein the sound attenuation panels are configured to couple to a portion of the housing of the HVAC device, and at least one sound attenuation panel is configured to couple to the replacement cover, and wherein the sound attenuation panels are configured to form a discontinuous section on a portion of the housing, wherein the discontinuous section is configured to be aligned with one or more openings in the HVAC device housing.

In some example implementations of the retrofit kit of any example implementation, or any combination of any preceding example implementation, the replacement cover comprises an enlarged region.

In some example implementations of the retrofit kit of any example implementation, or any combination of any preceding example implementation, the enlarged region is equal to or greater than the size of the at least one sound attenuation panel configured to couple to the replacement cover.

In some example implementations of the retrofit kit of any example implementation, or any combination of any preceding example implementation, the HVAC device comprises a gas-fired furnace comprising a combustion chamber, wherein the combustion chamber comprises a burner assembly and a combustion air fan, and wherein the first frequency band includes the frequency of operation of at least one of the burner assembly and the combustion air fan.

In some example implementations of the retrofit kit of any example implementation, or any combination of any preceding example implementation, the acoustic metamaterial layer comprises a first stacked structured, wherein the first stacked structure comprises a first perforated sheet layer arranged over a spacer layer arranged over a second perforated sheet layer.

In some example implementations of the retrofit kit of any example implementation, or any combination of any preceding example implementation, at least one of the sound attenuation panels comprises a first portion where the acoustic metamaterial layer comprises the first stacked structure and a second portion that comprise a second double stacked structure, wherein the second double stacked structure comprises a third perforated sheet layer arranged over a second spacer layer arranged over the first stacked structure.

In some example implementations of the retrofit kit of any example implementation, or any combination of any preceding example implementation, at least one sound attenuation panel includes a chambered edge.

In some example implementations of the retrofit kit of any example implementation, or any combination of any preceding example implementation, the at least one of the sound attenuation panels includes a notch.

In some example implementations of the retrofit kit of any example implementation, or any combination of any preceding example implementation, at least one of the sound attenuation panels comprises magnets on a first side of the sound attenuation panels, wherein the magnets are configured to couple the sound attenuation panel to the housing at a given orientation.

In some example implementations of the retrofit kit of any example implementation, or any combination of any preceding example implementation, at least one of the sound attenuation panels further comprises a first set of sound attenuation protrusions, wherein the first set of sound attenuation protrusions are configured to align with one or more apertures located at one of the HVAC device openings.

In some example implementations of the retrofit kit of any example implementation, or any combination of any preceding example implementation, the first set of sound attenuation protrusions comprise acoustic metamaterial.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
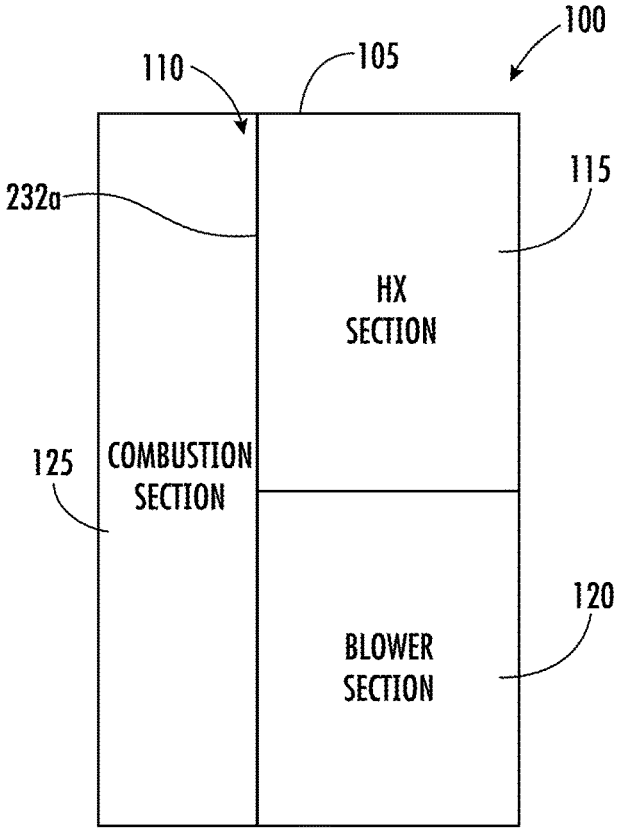
FIG. 1 is a schematic diagram of a gas-fired furnace, according to an example embodiment of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[a] or [b]" is true if [a] is true, or if [b] is true, or if both [a] and [b] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration, such as located at a residence or building). It is understood that such terms are not used in any absolute sense.

Example implementations of the present disclosure relate generally to an improved HVAC device and components thereof that attenuate low-frequency noise, and thus may result in a quieter device. Example implementations will be primarily described in conjunction with furnaces used in HVAC applications, but it should be understood that example implementations may be utilized in conjunction with a variety of other applications. For example, other HVAC devices include, but are not limited to, indoor units, outdoor units, heaters (electric or otherwise), heat pumps, transport units, variable air volume units (VAVs), power induction units (PIUs), boilers as well as other devices generally including water heaters, kitchen appliances, and the like may utilize the system and method described herein.

Example embodiments of the present disclosure utilize acoustic metamaterial layers, sometimes in the form of panels, coupled to an HVAC device in order to improve the acoustical performance while minimizing potential impact on the general functionality of the HVAC device. This is achieved, in part, by strategically locating acoustic metamaterial layers, varying the thickness or number of layers, tuning the material to attenuate sound at certain frequencies bands, and other techniques discussed herein. Furthermore, the embodiments herein account for the other characteristics associated with HVAC devices, including but not limited to, fluid flow characteristics (e.g., static pressure drop, turbulence, etc.), heat transfer properties, electrical requirements, and other aspects of the HVAC device that may be impacted by the acoustical components associated with the embodiments disclosed herein.

One example embodiment includes a furnace design. An overview of this embodiment is provided followed by a more detailed discussion of the features associated with this disclosure. In some embodiments, the improved furnace includes a combustion air chamber, heat exchanger chamber, and a circulation blower chamber located within a furnace housing. In some embodiments, each of these chambers includes various sound producing components. In some embodiments, the combustion air chamber includes a burner assembly and a combustion air fan, which both may produce sound when the furnace is in operation. In some embodiments, the furnace includes sound attenuation features designed to attenuate sound emanating from the combustion air chamber. In some embodiments, the sound attenuation features include a sound attenuation layer comprising acoustic metamaterial. In some embodiments, the acoustic metamaterial is tuned to attenuate sound at a given frequency band, potentially a first frequency band. In some embodiments, this frequency band includes the operating frequency of the burner assembly and/or the combustion air fan within the combustion air chamber. In some embodiments, the furnace housing includes various housing openings. In some embodiments, the housing openings connect the interior of the various chambers within the housing to an ambient environment. For example, in some embodiments, the housing openings fluidly connect the interior of the combustion air chamber to the ambient environment. In some embodiments, the housing openings provide less sound attenuation than the housing itself for sound emanating from within or through the combustion air chamber. In some embodiments, the sound attenuation layer is coupled to the combustion air chamber and only covers a portion of the combustion air chamber. In some embodiments, the sound attenuation layer does not cover one or more of the housing openings associated with the combustion air chamber.

In some embodiments, the various sound attenuating components of this disclosure are incorporated within a kit. In some embodiments, this kit is designed to couple to an existing HVAC device, potentially a furnace, with minimal impact to the overall heating performance of the existing HVAC device. In some embodiments, the kit includes a plurality of sound attenuation panels. In some embodiments, the sound attenuation panels comprise acoustic metamaterial, and in some embodiments, the acoustic metamaterial is designed to attenuate sound at a frequency band, potentially a first frequency band. In some embodiments, the frequency band covers the frequency of operation of various sound producing components within an HVAC enclosure. In some embodiments, the frequency band covers the frequency of operation of a burner assembly and/or a combustion air fan within a combustion air chamber of a furnace. In some embodiments, the sound attenuation panels are designed to couple to the existing housing and/or structure of an HVAC device. In some embodiments, the kit includes a replacement cover designed to replace an existing door or panel of the housing associated with the HVAC device. In some embodiments, the replacement cover is designed to adjust the geometry of the housing in some manner. In some embodiments, the replacement cover is designed to enlarge the housing size to accommodate at least one sound attenuation panel. In some embodiments, the replacement cover enlarges the housing size in a manner that is equal to or larger than the size of the sound attenuation panel configured to couple to the replacement cover. In some embodiments, the housing of the HVAC device includes one or more openings that fluidly couple the interior of the housing and/or chamber within the housing to an ambient environment. In some embodiments, the sound attenuation panels couple to a housing and/or chamber within the housing such that they only cover a portion of the housing and/or chamber. In some embodiments, the sound attenuation panels are configured such that they do not cover one or more housing openings associated with the housing and/or chamber.

Figure 2:
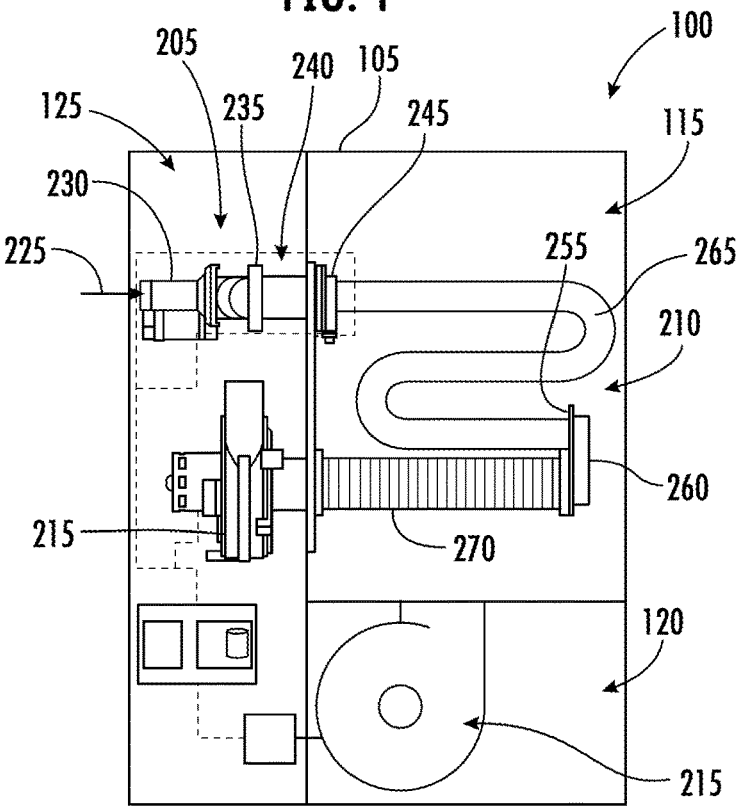
FIG. 2 is a schematic diagram of components within a gas-fired furnace, according to an example embodiment of the present disclosure.
Figure 3:
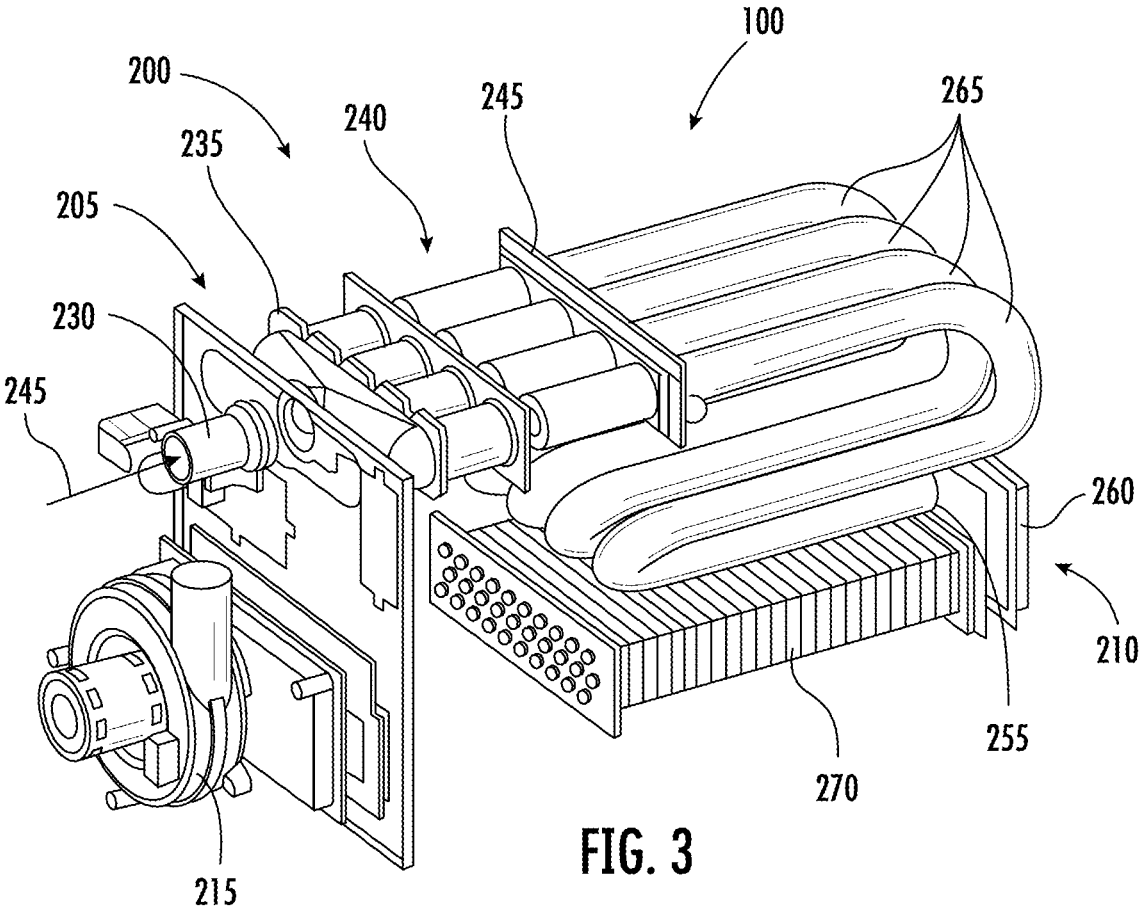
FIG. 3 is an illustration of example of components for a gas-fired furnace, according to an example embodiment of the present disclosure.

Referring now to FIGS. 1-3, example embodiments of a gas-fired furnace 100 are shown that may utilize the improved sound attenuation features disclosed in the present application. As discussed herein, furnace 100 may be referred to as being "gas-fired", where the "gas-fired" furnace is configured to be in fluid communication with a gas supply for thermodynamic heat transfer. In some embodiments, furnace 100 may comprise components of an HVAC system that includes an indoor unit comprising furnace 100 or an outdoor unit. Furnace 100 may be configured as an indoor furnace that provides conditioned fluid, often air, to a comfort zone of an indoor space. However, in general, the components of furnace 100 may be equally employed in an outdoor or weatherized furnace to condition an indoor space. Moreover, furnace 100 may be used in residential or commercial applications.

FIG. 1 shows a schematic of an example enclosure 105 that may be implemented with the furnace 100 in some embodiments. The enclosure 105, potentially a housing, has an interior space 110 that may be partitioned into a plurality of chambers: a heat exchanger chamber 115, a circulation blower chamber 120, and a combustion chamber 125. FIG. 1 further shows how the chambers may be arranged within the furnace 100.

FIGS. 2 and 3 show schematics of various components that may be included within furnace 100. In the embodiments depicted in FIGS. 2 and 3, furnace 100 includes a burner assembly 205, a heat exchanger assembly 210, a combustion air blower 215, a circulation air blower 220, multiple controllers, and other associated components. In the embodiments shown in FIGS. 2 and 3, the combustion air flow follows a combustion air flow path (indicated by arrow 225) that may be in a direction beginning at the air/fuel mixing unit 230, extending through various components to the combustion air blower 215. The combustion air flow path 225 continues to an exhaust conduit (not shown in FIGS. 2 and 3).

In some embodiments, the combustion air flow described above may be introduced into furnace 100 by a fan or blower. This blower may be a draft inducer (as shown in FIGS. 2 and 3) when the blower is operating in an induced draft mode and pulling the combustion air flow through furnace 100, or the blower may be a forced draft blower when the blower is operating in a forced draft mode and pushing the combustion air flow through furnace 100. In the depicted embodiments, the combustion air blower 215 is in fluid communication with combustion air flow path 225 and is downstream of heat exchanger assembly 210, which in some embodiments includes a secondary heat exchanger 270. Embodiments using a forced draft mode may be accomplished by placing a blower at the inlet of air/fuel mixing unit 230 and forcing the gas flow into and through air/fuel mixing unit 230 and along combustion air flow path 225.

Figure 6:
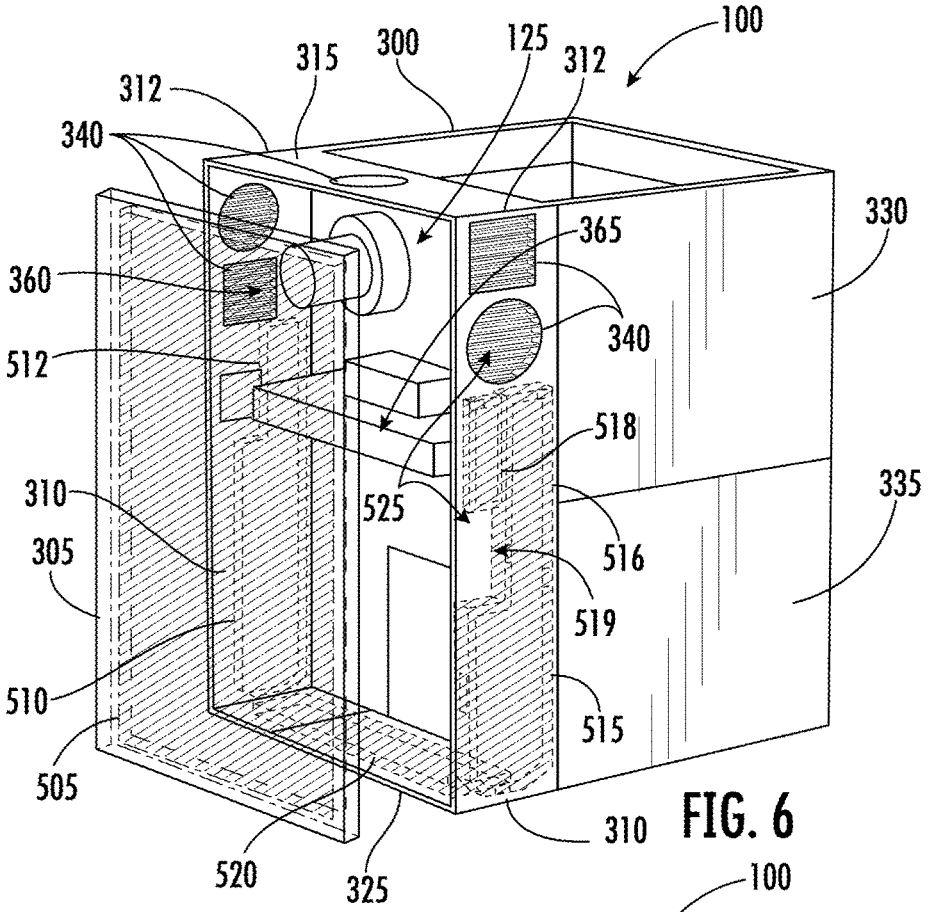
FIG. 6 is an angled view of a furnace with various sound attenuation features, according to an example embodiment of the present disclosure.
Figure 7:
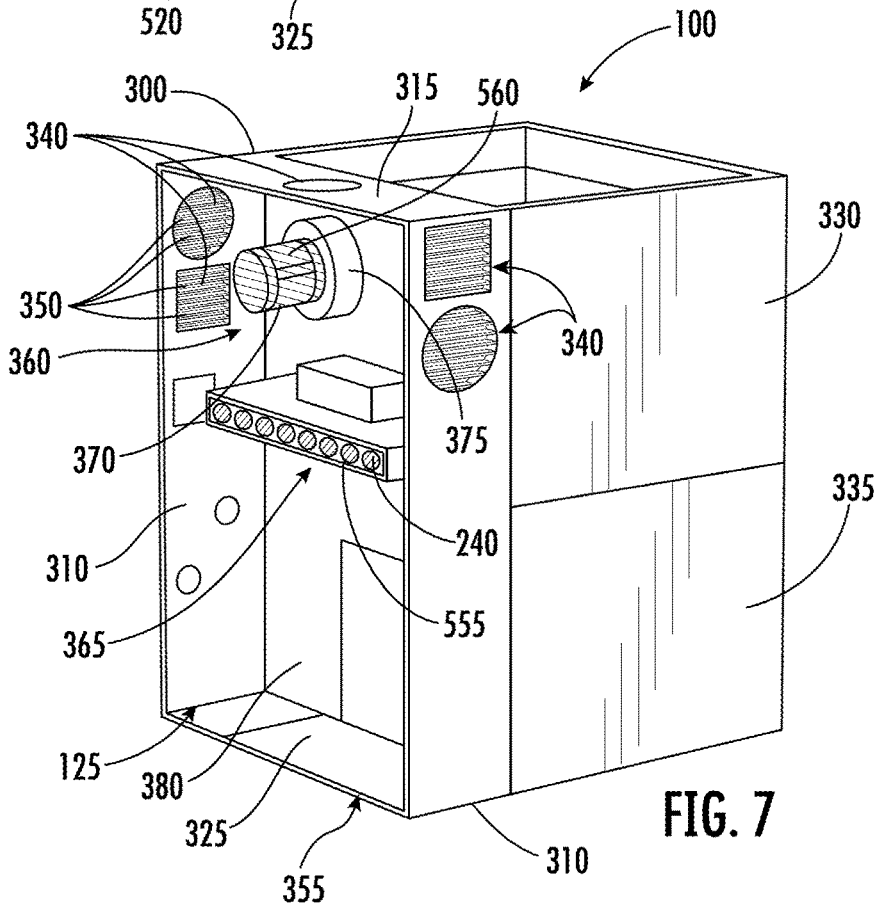
FIG. 7 is another angled view of a furnace with various sound attenuation features, according to an example embodiment of the present disclosure.

In the depicted embodiment, the burner assembly 205 may include an air fuel mixing unit 230, manifold 235, and one or more burners 240. The heat exchanger assembly 210 may include a first heat exchanger end 245 coupled to intake manifold 235 and a second heat exchanger end 255 coupled to hot collector box 260, and a plurality of heat exchanger tubes 265. In some embodiments, a finned condensing heat exchanger 270 may extend from the hot collector box 260 to the combustion air blower 215. However, generally, furnace 100 may be operated with or without a condensing heat exchanger as a "condensing" or "non-condensing" furnace, respectively. Some embodiments, for example some non-condensing furnace embodiments, may also arrange the various components discussed above in other configurations. For example, in some embodiments, the combustion air may enter into the heat exchanger chamber in the lower section and the combustion air may flow upwards through the heat exchanger tubes, exiting the heat exchanger chamber at an upper section. In these embodiments, the burner assembly may be located in the middle portion of the combustion air chamber and the combustion air blower may be located near the upper section. FIGS. 6 and 7 show example embodiments of how the combustion air chamber may be configured in these embodiments. Other configurations and implementations for furnaces and other HVAC devices may also be utilized in accordance with the present disclosure.

Figure 4A:
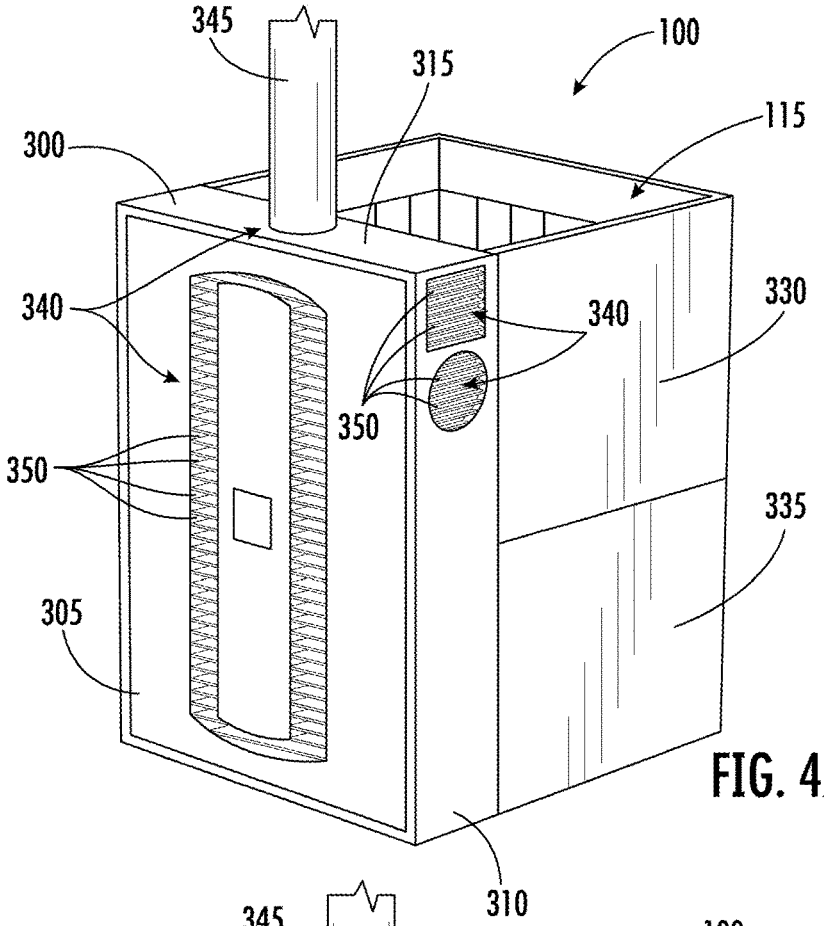
FIG. 4A is an angled view of a furnace, according to an example embodiment of the present disclosure.
Figure 4B:
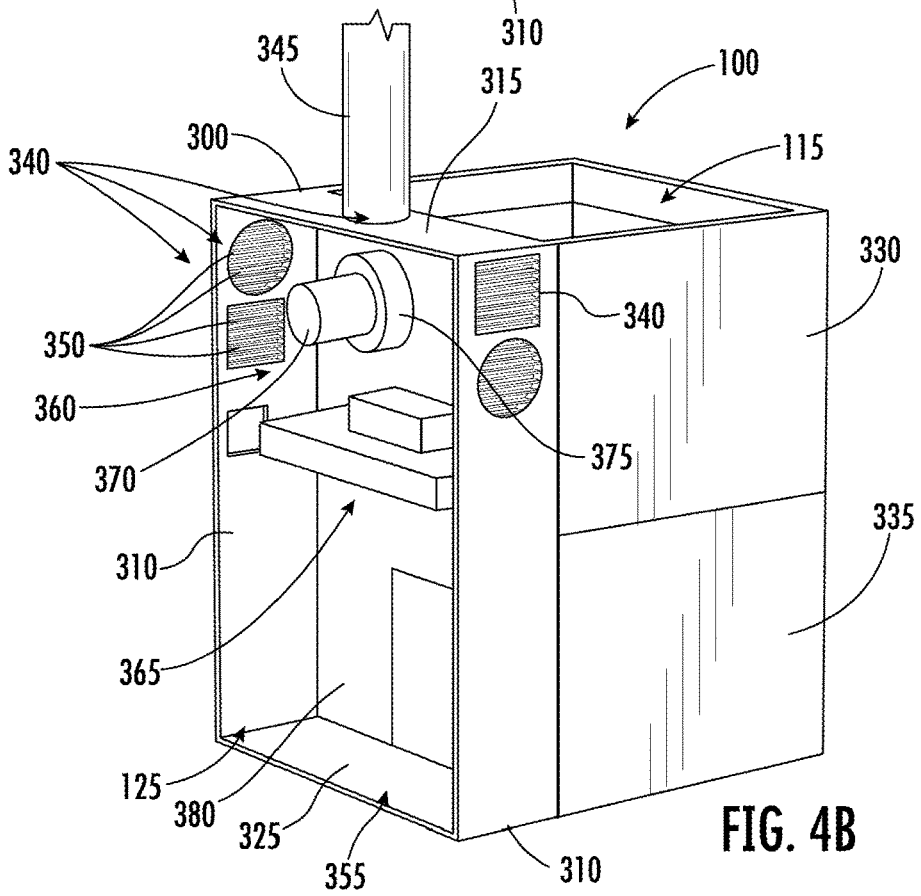
FIG. 4B is another angled view of a furnace with the combustion chamber door removed, according to an example embodiment of the present disclosure.

FIGS. 4A and 4B show an angled view of an embodiment of a combustion chamber for a gas-fired furnace that may utilize the disclosure features. FIG. 4A shows an angled view of a housing 300 for furnace 100. In the depicted embodiment, the housing 300 encloses the heat exchanger chamber 115, the blower chamber 120 (shown in FIG. 2), and the combustion chamber 125 (shown in FIG. 4B). In the depicted embodiment, the housing 300 includes a plurality of panel walls forming the structure or part of the structure associated with the housing. In the depicted embodiment, the housing 300 includes a front combustion air wall panel 305 (potentially a door in some embodiments), side combustion air wall panels 310, a top combustion air wall panel 315, a bottom combustion air wall panel 325 (shown in FIG. 4B), side heat exchanger wall panels 330, side circulation air wall panels 335 as well as front exchanger wall panels and front circulation air wall panels (not shown) located opposite the front combustion air wall panel 305. An additional side heat exchanger wall panel 330 and an additional side circulation blower wall panel 335 are located opposite the side heat exchanger wall panel 330 and the side circulation air wall panel 335 shown in the depicted embodiments. The combustion air chamber 125 also includes a combustion air partition 380 (shown in FIG. 4B) separating the combustion air chamber 125 from the heat exchanger chamber 115 and the circulation air blower chamber 120. The housing 300 also includes housing openings, which may fluidly connect one or more enclosures within the housing to the environment outside the housing. For example, the depicted embodiment includes multiple combustion air chamber openings 340 connecting the combustion air chamber 125 to the environment outside housing 300. In some embodiments, a conduit or a duct may be coupled to a housing opening, for example, in the depicted embodiment, an exhaust flue 345 is connected to one of the combustion air openings 340. In some embodiments, the housing opening may include a plurality of apertures. For example, in the depicted embodiment, a combustion air chamber opening 340 located on the front combustion air wall panel 305 contains multiple opening apertures 350. In the depicted embodiment, the combustion air openings 340 on the side combustion air wall panel 310 also includes multiple opening apertures 350.

The embodiment depicted in FIG. 4B shows an angled view of the combustion air chamber 125 with the front combustion air wall panel 305 removed. In the depicted embodiment, the combustion air chamber 125 includes a hollow space 355 that houses various components, including a combustion air blower 360, a burner assembly 365, and various other components. In the depicted embodiment, the combustion air blower 360 may be similar or the same as the combustion air blower 215 shown in FIGS. 2 and 3, and the burner assembly 365 may be similar or the same as the burner assembly 205 shown in FIGS. 2 and 3. In some embodiments, both the combustion air blower 360 and the burner assembly 365 are sound producing components. In some embodiments, the combustion air blower 360 includes a motor 370 and a blower chamber 375, each of which produces sound. In some embodiments, the components of the burner assembly 365 produce sound, for example, the burners may produce sound as the air/gas mixture ignites and the mixture expands. These various components may produce noise at different frequencies, or some or all of these components may produce noise at the same or similar frequencies. In some embodiments, some or all of these components produce sound within a frequency band that includes 400 Hz to 500 Hz.

Figure 5A:
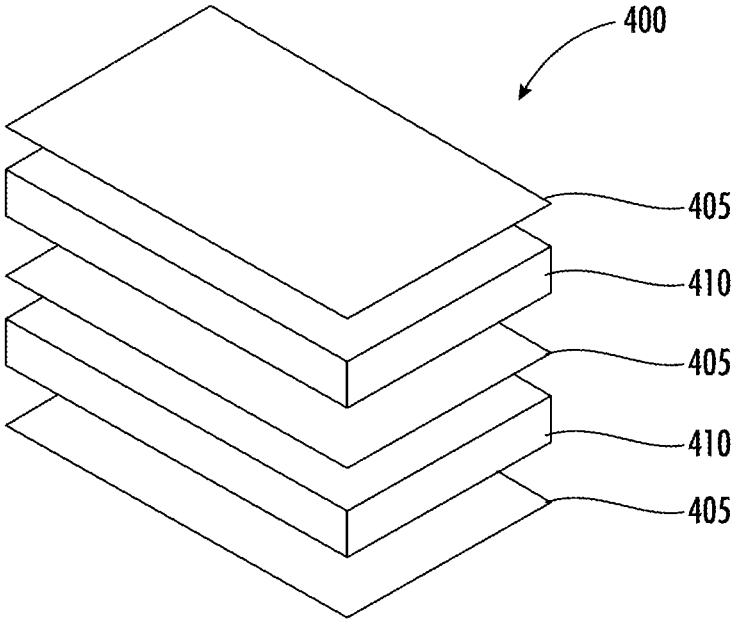
FIG. 5A is an illustration of layers of acoustic metamaterial, according to an example embodiment of the present disclosure.
Figure 5B:
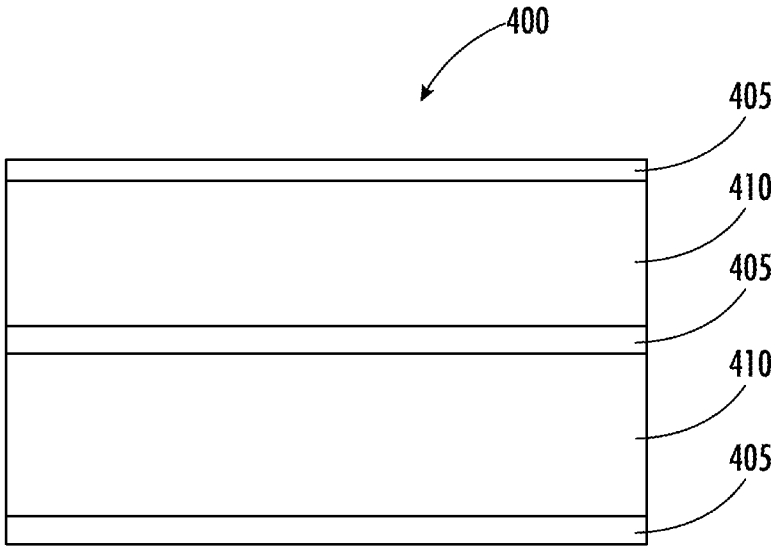
FIG. 5B is another illustration of layers of acoustic metamaterial, according to an example embodiment of the present disclosure.

FIGS. 5A and 5B show illustrations of the structure of acoustic metamaterial layer(s) that may be utilized in some embodiments disclosed herein. The term acoustic metamaterials as used herein refers to materials containing embedded periodic resonant or non-resonant elements which modify the acoustic properties of the given material. In general, these elements modify the acoustical property by adjusting the dynamics of the sound waves propagating through the material and/or by wave scattering techniques. The embodiment depicted in FIG. 5B shows an example cross-section of acoustic metamaterial 400 according to some embodiments of the present disclosure. In the depicted embodiment, the acoustic metamaterial comprises alternating hard thin, perforated layers 405 and thicker, spacer layers 410. In the depicted embodiment, the thin, perforated layer 405 comprises a hard material with an acoustical impedance much higher than the surrounding environment (e.g., air in some embodiments). In some embodiments, this layer comprises a polycarbonate sheet (e.g., DuPont Melinex). In other embodiments, other forms of plastic sheets or metal sheets may be used. In the depicted embodiment, the perforated layer 405 comprises openings or holes within the layer. The ratio of the open areas created by these holes to the overall size of the layer is sometimes referred to as the percentage of open area ("POA"). In some embodiments, the POA is between 0.1%-1.7%, potentially 1.7%. In some embodiments, the openings are arranged in a given pattern, which may or may not vary. In some embodiments, the openings are a specific geometric shape that is consistent across the layer 405, and in some embodiments these openings vary.

In the depicted embodiment, the thicker layer 410, potentially a spacer layer, may comprise a softer material and may be used, in part, to space the perforated layer 405. In one embodiment, the thicker layer 410 comprises a fiberglass material (e.g., Micromat). Other materials may be used to form the thicker layer 410, and in some embodiments, the materials used are porous. In the depicted embodiment, the thicker layer 410 provides a constant spacing between the perforated layers 405, and in some embodiments, this layer is approximately ½" and provides that amount of spacing. Other embodiments may include different dimensions for this layer 410 and/or different spacing. Some embodiments may not include this layer and may use air or the surrounding medium in the space between the perforated layer 405.

The embodiments depicted in FIGS. 5A and 5B show an acoustic metamaterial comprising a stacked structure. In this embodiment, the stacked structure comprises an outer perforated layer 405 followed by the thicker, spacer layer 410, and then another perforated layer 405, the middle perforated layer 405 in the depicted embodiment. Some embodiments include a double stacked structure that comprises the first stacked structure, e.g., a first perforated layer arranged over a first thicker spacer layer arranged over a second perforated layer, and this first stacked structure is followed by a second thicker spacer layer arranged over the first stacked structure and a then a third perforated layer arranged over the second thicker spacer layer. The depicted embodiments in both FIGS. 5A and 5B illustrate a doubled stacked structure. Some embodiments of the present disclosure include more or less acoustic metamaterial layers and/or stacked structures.

In some embodiments, the acoustic metamaterial 400 is tuned to attenuate sound over a given frequency range, preferable a lower frequency range (e.g, less than 1000 Hz). This material can be tuned to attenuate sound at a broader or narrower frequency range as well as multiple different frequencies. In some embodiments, the acoustic metamaterial 400 is tuned to attenuate sound from specific sound producing components. In some embodiments, these sound producing components are selected due to the frequency of noise they produce, potentially independently of the magnitude of noise created. For example, in some embodiments, the acoustic metamaterial 400 is tuned to attenuate sound from a given component because it produces low frequency noise (e.g., a burner assembly, a combustion air fan, etc.), but not another component that produces a greater total amount of noise (e.g., a heat exchanger assembly). In some embodiments, the material is tuned to attenuate sound at a frequency band ranging from approximately 400 Hz to 500 Hz, and in some embodiments, this frequency band covers the operating frequency of the combustion air fan and the burner assembly. This tuning may be performed in a variety of different ways. For example, in the depicted embodiment, which utilizes a stacked acoustic metamaterial configuration, the acoustic metamaterial can be tuned to a given frequency range by adjusting the POA of one or more of the perforated layers 405. Adjusting the size or patterns of the openings on the perforated layer 405 may also impact the tuned frequency band. The spacing between these layers and/or the thickness of the thicker layer 410 may also impact the frequency range. Additionally, the materials used and their acoustic properties is another factor that can affect the tuned frequency in the depicted embodiment. Other methods for tuning the acoustic material are contemplated within the scope of this disclosure, and this is only one example embodiment of the acoustic metamaterial that may be used according to the disclosure herein. Accordingly, to the extent another configuration is utilized that configuration may also be tuned to attenuate sound to reduce sound in a similar manner.

FIG. 6 shows an embodiment of a gas-fired furnace 100 that includes sound attenuation features. In the depicted embodiment, the sound attenuation features are included within the combustion air chamber 125, and in some embodiments, the sound attenuation features are designed to attenuate sound from sound producing components within the combustion air chamber 125. In some embodiments, the sound attenuation features comprise a sound attenuation layer composed in whole or in part from acoustic metamaterial. In some embodiments, the acoustic metamaterial comprises a stacked configuration as depicted in FIGS. 5A and 5B. In some embodiments, the acoustic metamaterial comprises a first and a second layer of acoustic metamaterial. In the embodiment depicted in FIG. 6, the sound attenuation layer comprises multiple, separate sound attenuation panels. These panels are generally planar. In some embodiments, the sound attenuation layer comprises a continuous layer of sound attenuation material. In some embodiments, the sound attenuation layer is flexible and may include bends or curves.

In some embodiments, the sound attenuation layer is tuned to attenuate sound from one or more of the sound producing components located within the combustion air chamber 125. In some embodiments, the sound attenuation layer is tuned to attenuate sound from the combustion air blower 360 and/or the components with burner assembly 365 (e.g., air/fuel mixing unit, manifold, burners, etc.). The sound attenuation layers may be tuned to other components as well.

In the embodiment depicted in FIG. 6, the sound attenuation layer is arranged within the combustion air chamber 125 in order to maximize sound absorption, particularly low-frequency noises, while minimizing impact on the operations of the furnace 100. In the depicted embodiment, a portion of the sound attenuation layer is coupled to the front combustion air wall panel 305. In this embodiment, this portion of the sound attenuation layer may be referred to as the front sound attenuation wall panel 505. In the depicted embodiment, the front sound attenuation panel 505 is coupled to the interior of the front combustion air wall panel 305. In the depicted embodiment, the front sound attenuation panel 505 spans the length and width of the front combustion air wall panel 305. In some embodiments, the front sound attenuation panel 505 may be coupled to the exterior of the combustion air front wall panel 305. In some embodiments, the front sound attenuation panel 505 spans only a portion of the front combustion air wall panel 305. In the embodiment depicted in FIG. 6, the front combustion air wall panel 305 is continuous and does contain any opening. In some embodiments, the combustion air wall panel 305 contains openings 340 (e.g., the embodiment shown in FIG. 4A). In some embodiments, the front sound attenuation panel 505 contains openings (e.g., the embodiments shown in FIGS. 14A-D). In some embodiments, the openings in the front sound attenuation panel 505 match the openings in the front combustion air wall panel 305. Other configurations for the front sound attenuation panel and/or the attenuation layer coupled to the front panel of a furnace or other HVAC device are contemplated within the scope of the disclosure herein.

In the embodiment depicted in FIG. 6, the sound attenuation layer includes two side sound attenuation panels coupled to the interior of both side combustion air wall panels 310. In the depicted embodiment, these portions of the sound attenuation layer may be referred to as side sound attenuation panels 510 and 515 respectively. In the depicted embodiment, the side sound attenuation panels 510 and 515 are coupled to the interior of side combustion air wall panels 310. In other embodiments, the side sound attenuation panels 510 and 515 may be coupled to the exterior of the side combustion air wall panels 310. In some embodiments, the side sound attenuation panels 510 and 515 spans the entire width and length of the side combustion air wall panels 310. In some embodiments, the side sound attenuation panels 510 and 515 contains openings.

In the depicted embodiment, the side sound attenuation panel 510 spans only a portion of one of the side combustion air wall panel 310. In the depicted embodiment, side sound attenuation panel 510 spans a portion of the length of the side combustion air wall panel 310. In the depicted embodiment, side sound attenuation panel 510 terminates a distance from an upper end 312 of the side combustion air wall panel 310. In the depicted embodiment, the side sound attenuation panel 510 terminates before combustion air openings 340. In the depicted embodiment, side sound attenuation panel 510 spans the width of the lower section of the side combustion air wall panel 310. In this embodiment, the side sound attenuation panel 510 includes a narrow elongated portion 512 that extends around various components coupled to one of the side combustion air wall panels 305.

In the depicted embodiment, the side sound attenuation panel 515 spans only a portion of one of the side combustion air wall panel 310. In the depicted embodiment, side sound attenuation panel 515 spans a portion of the length of the side combustion air wall panel 310. In the depicted embodiment, side sound attenuation panel 515 terminates a distance from an upper end 312 of the side combustion air wall panel 310. In the depicted embodiment, the side sound attenuation panel 515 terminates before combustion air openings 340. In the depicted embodiment, side sound attenuation panel 515 spans the width of the lower section of the side combustion air wall panel 310. In this embodiment, the side sound attenuation panel 515 includes a narrow elongated portion 516 that extends around various components coupled to one of the side combustion air wall panel 305. In the depicted embodiment, the elongated portion 516 on side sound attenuation panel 515 is a different length than the elongated portion 512 on side sound attenuation panel 510. In some embodiments, the elongated portion on the side sound attenuation panels are the same length. In some embodiments, the length of the elongated portion varies between the sound attenuation panels and/or the sound attenuation panels do not include elongated portions. In the depicted embodiment, side sound attenuation panel 515 includes an extended portion 518 that extends horizontally from the elongate portion 516. In the depicted embodiment, the extended portion 518 extends from the top edge of the elongated portion 516 and for only a portion of the length of the elongate portion 516, creating a notch 519 in side sound attenuation panel 515. In some embodiments, the elongated portion in one of or both side sound attenuation panel(s) includes an extended portion that widens the elongated portion in a given direction for some of all of the elongated portions length. Other configurations for the side sound attenuation panel(s) and/or the attenuation layer coupled to the side panel(s) of a furnace or other HVAC device are contemplated within the scope of the disclosure herein.

In the depicted embodiment, the sound attenuation layer includes a bottom sound attenuation panel coupled the interior of the bottom combustion air wall panel 325. In the depicted embodiment, this portion of the sound attenuation layer may be referred to as the bottom sound attenuation panel 520. In the depicted embodiment, the bottom sound attenuation panel 520 is coupled to the interior of the bottom combustion air wall panel 325. In the depicted embodiment, the bottom sound attenuation panel 520 spans the length and width of the bottom combustion air wall panel 325. In other embodiments, the bottom sound attenuation panel 520 may be coupled to the exterior of the bottom combustion air wall panel 325. In some embodiments, the bottom sound attenuation panel 520 spans only a portion of the bottom combustion air wall panel 325. In some embodiments, the bottom sound attenuation panel 520 contains openings. Other configurations for the bottom sound attenuation panel and/or the attenuation layer coupled to the bottom panel of a furnace or other HVAC device are contemplated within the scope of the disclosure herein.

In the embodiment depicted in FIG. 6, the sound attenuation layer forms a discontinuous section 525 where the sound attenuation layer fails to cover. This discontinuous section 525, i.e., the uncovered section, is formed either because the sound attenuation layer includes an opening and/or fails to extend across a given panel or structure to create a sound path. For clarity, walls or structures that do not include the sound attenuation layer are not considered a discontinuous section in this disclosure. Rather, discontinuous sections include walls or structures that include a sound attenuation layer and the sound attenuation layer is structured to create an opening or uncovered section in order to create a discontinuation section on the wall or structure. To further illustrate, in the embodiment depicted in FIG. 6 the discontinuous section 525 comprises layers where the sound attenuation layer does not cover a given wall and/or panel. In the depicted embodiment, side sound attenuation panels 510 and 515 both form discontinuous sections 525 along the upper portion of each side combustion air panel 310. These discontinuation sections 525 are formed where the sound attenuation panels 510 and 515 terminate short of the length of the side combustion air panels 310, which provide sections in the side combustion air panels 310 that do not include the sound attenuation layer. Discontinuous sections are also formed where the elongated portions 512 and 516 form an uncovered portion along the width of the side combustion air wall panel 305 that are not covered by the sound attenuation layer. These discontinuation sections 525 may provide less sound attenuation, or less sound attenuation of a given frequency band, than other sections of a given wall and/or structure. Walls or structures that do not include any sound attenuation layer are not considered discontinuous sections in the present disclosure, however, they may operate similarly. For example, in the depicted embodiment the top combustion air wall panel 315 is not coupled to the sound attenuation layer. In the depicted embodiment, the combustion air partition 380 is also not coupled to any sound attenuation layer. In some embodiments, the discontinuation sections and/or the walls and structures not including any sound attenuation layer are located at various points within the housing, chamber, or other structure in a manner that balances the need for sound attenuation via the sound attenuation layer and other considerations such as device performance, thermal characteristics, other acoustical factors, etc. The embodiment shown in FIG. 6 shows one illustrative configuration. Other configurations for the side sound attenuation panel(s) and/or the attenuation layer to the side panel(s) of a furnace or other HVAC device are contemplated within the scope of the disclosure herein.

In the depicted embodiment, the sound attenuation panel is attached to the panels on the combustion air chamber via magnets (not shown in FIG. 6). In this embodiment, these magnets are located on the sound attenuation panels to allow support across a given panel. In some embodiments, the magnets are located on one side of the panel to ensure the panel is located appropriately. Some embodiments may utilize other coupling mechanisms. For example, in some embodiments, fasteners (e.g., screws, bolts, staples, nails, etc.) are used as coupling mechanisms, and some embodiments may include other mechanisms such as slip fits, clamps, tape, bayonet connectors, etc. In some embodiments the panels and/or walls include sound attenuation layers incorporated within the panel and/or wall.

The embodiment depicted in FIG. 7 illustrates another embodiment of a furnace utilizing sound attenuation features. In the depicted embodiment, the furnace includes two sound attenuation layers. In the depicted embodiment, a layer 550 is coupled to the combustion air blower and a layer 555 is coupled to the burner assembly. In the depicted embodiment, the combustion air blower layer 550 is coupled to the motor 370. In other embodiments, layer 550 may be coupled to both the motor 370 and blower compartment 375, and in other embodiments, it is only coupled to the blower compartment 375. In the depicted embodiment, the layer 555 is coupled to the burner assembly 335. In some embodiments, layer 555 is coupled to some or all of the following components: air/gas mixing unit 230, manifold 235, and/or burners 240. This disclosure contemplates other sound attenuation layers and/or configurations may be used.

In the embodiment depicted in FIG. 7, the sound attenuation layers 550 and 555 are tuned to attenuate sound within the frequency range that includes the operating frequency of the motor 370 and the burners 240. In some embodiments, layer 550 is tuned to attenuate sound within a narrower frequency band, potentially one that only includes the frequency of operation of the motor 370. In some embodiments, layer 555 is tuned to attenuate sound at a narrower frequency band, potentially one that only includes the frequency of operation of the burners 240. In some embodiments, layer 550 and/or layer 555 are tuned to cover a broader frequency band. In some embodiments, the sound attenuation layers are tuned to cover a frequency band that overlaps. In some embodiments, sound attenuation layers are tuned to cover non-overlapping frequency bands. This disclosure, however, contemplates a variety of different sound attenuation layers tuned to attenuate sound from the same or different frequency bands which may include sound produced by any of the elements discussed above or other components utilized by the HVAC device.

Figure 8:
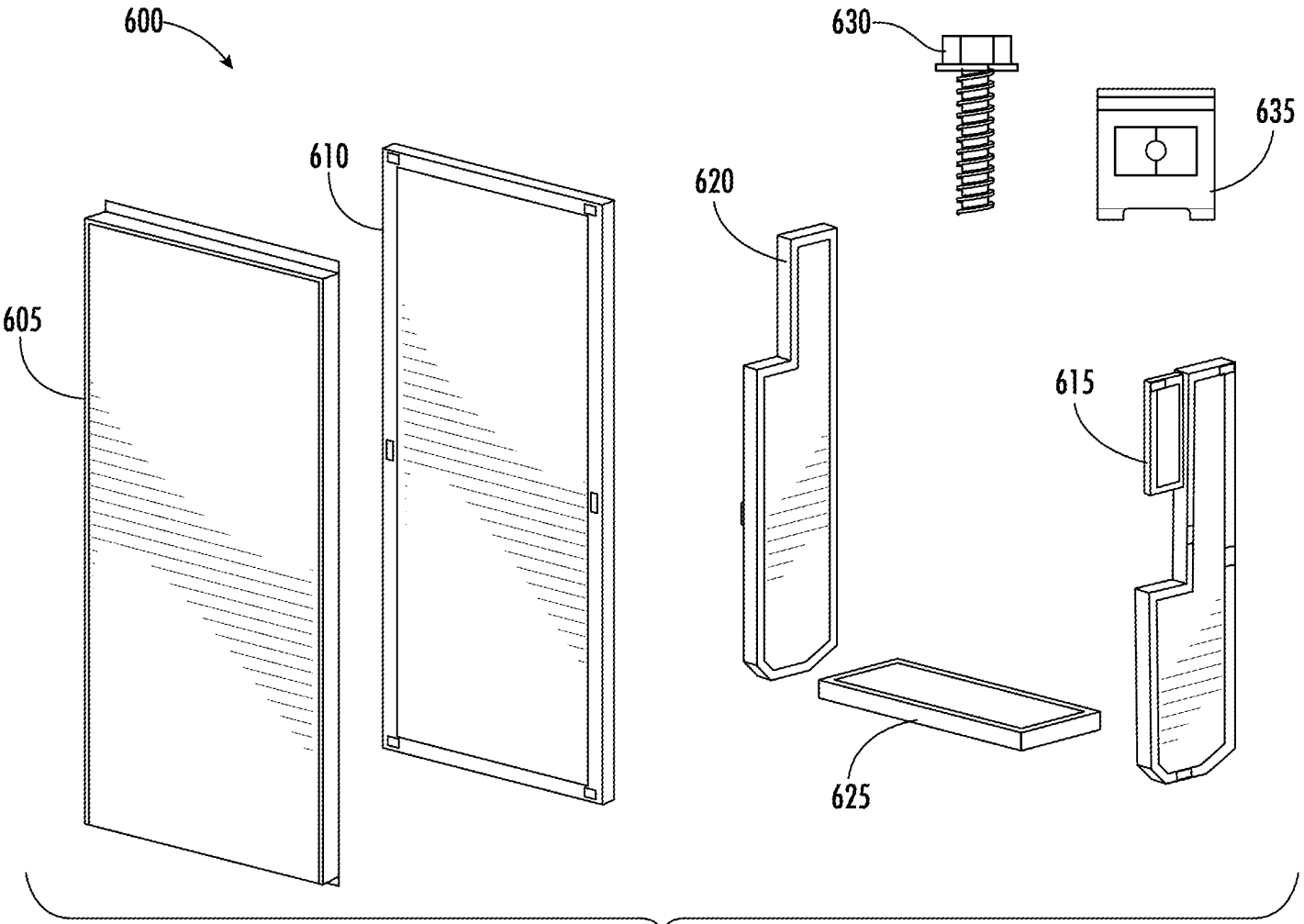
FIG. 8 is an illustration of a sound attenuation kit, according to an example embodiment of the present disclosure.
Figure 9D:
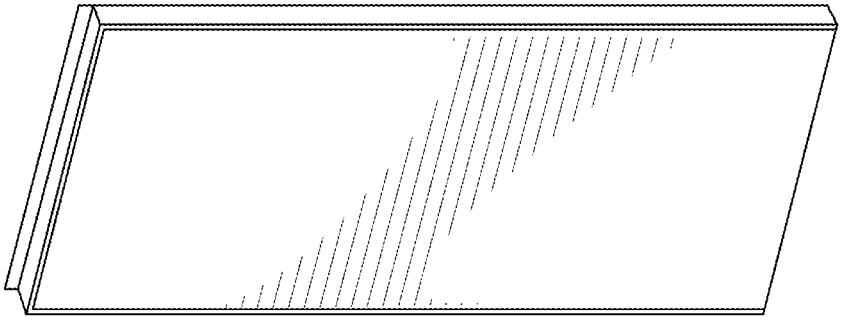
FIG. 9D is an angled view of a replacement cover, according to an example embodiment of the present disclosure.
Figure 9C:
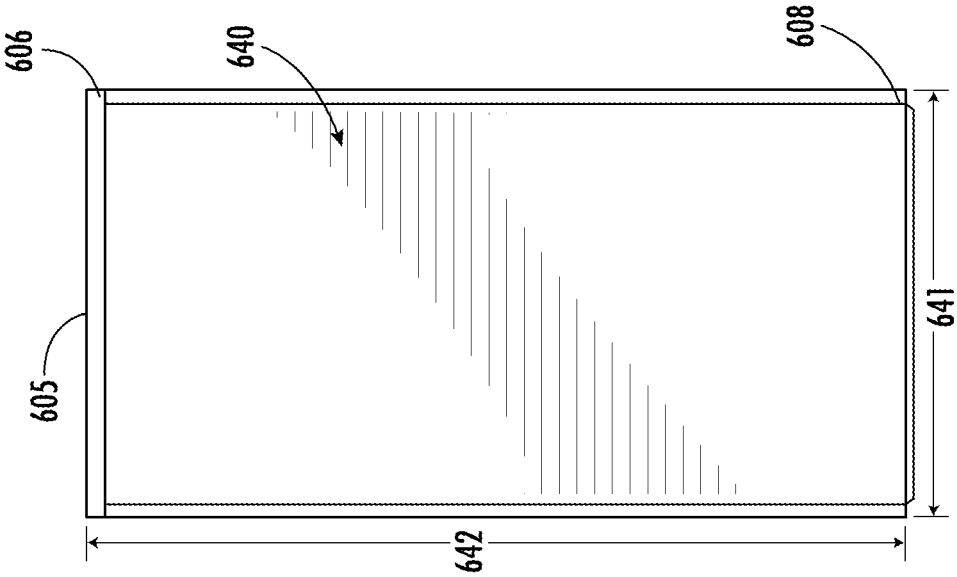
FIG. 9C is a rear view of a replacement cover, according to an example embodiment of the present disclosure.
Figure 9B:
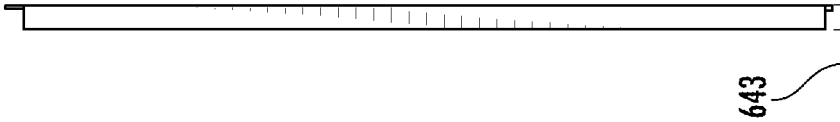
FIG. 9B is a side view of a replacement cover, according to an example embodiment of the present disclosure.
Figure 9A:
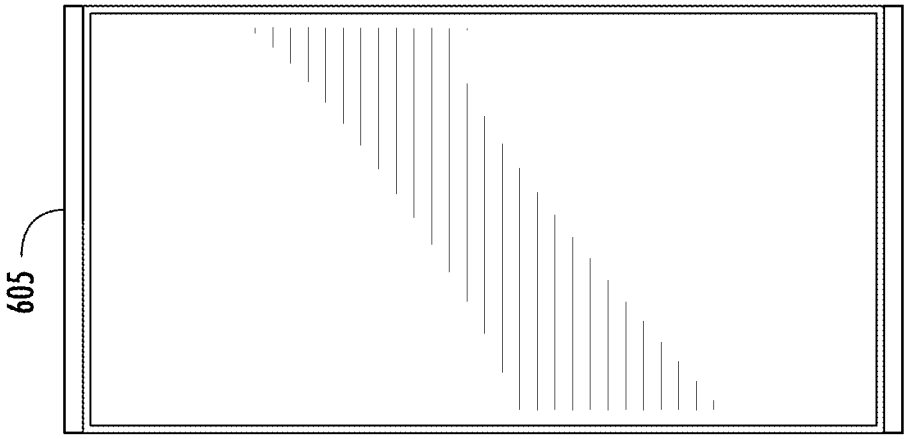
FIG. 9A is a front view of a replacement cover, according to an example embodiment of the present disclosure.

FIG. 8 shows an example embodiment of a sample sound attenuation kit 600 that may be used to improve the sound attenuation of an HVAC device, potentially an existing HVAC device. In the depicted embodiment, kit 600 includes a replacement cover 605, a first sound attenuation panel 610, a second sound attenuation panel 615, third sound attenuation panel 620, a fourth sound attenuation panel 625, one or more brackets 630, and one or more fasteners 635. Other embodiments include more or less components. For example, some embodiments, may also include top sound attenuation panel(s), additional sound attenuation panels and/or sound attenuation layers, including flexible attenuation layers, additional replacement covers, and/or other components. In some embodiments, the sound attenuation kit 600 is configured to and couples to a furnace in the manner shown in FIG. 6

FIGS. 9A-D show an illustration of a replacement cover 605. In the depicted embodiment, replacement cover 605 replaces the front combustion air wall panel 305. The depicted replacement cover 605 is sized such that it has the same length and width as the front combustion air wall panel 305. In the depicted embodiment, the replacement cover 605 includes a top and bottom flange 606 and 608, respectively. In some embodiments, the replacement cover attaches to an existing HVAC device via the bracket 630 and/or a fastener 635 coupling the flanges 606 and 608 to an existing HVAC device, potentially the front side of the combustion compartment of a furnace. In some embodiments, the replacement cover 605 only covers a portion of the panel being replaced. In some embodiments, the replacement cover 605 attaches over an existing panel or portion of a panel. In some embodiments, the replacement cover 605 attaches to multiple existing walls or structures. Other configurations are contemplated within the scope of this disclosure.

In the depicted embodiment, replacement cover 605 includes an enlarged region 640 that extends, or enlarges, the overall housing size. In this embodiment, the enlarged region 640 is sized to receive a sound attenuating panel, potentially the front sound attenuating panel 610. In the depicted embodiment, the enlarged region 640 is sized such that it is slightly larger than the front sound attenuating panel 610, allowing the front sound attenuating panel 610 to fit within the enlarged region 640 with minimal clearance. In the depicted embodiment, the first sound attenuation panel 610 spans the length and width of the enlarged region 640. In some embodiments, the enlarged region is sized to receive two or more sound attenuation panels. In some embodiments, the replacement cover 605 includes two or more enlarged regions. In some embodiments, each enlarged region within the replacement panel is configured to receive one or more sound attenuation panels. In some embodiments, one or more of the enlarged regions is configured to receive other components (e.g., electronic controllers, sensors, etc.). In some embodiments, the enlarged region is configured to arrange two or more sound attenuation panels in a given pattern. In some embodiments, the enlarged region is configured to arrange the two or more sound attenuation panels to form a discontinuous section. Other configurations and arrangements for the replacement cover are contemplated within the scope of this disclosure.

Figures 10A, 10B, 10C, 10D:
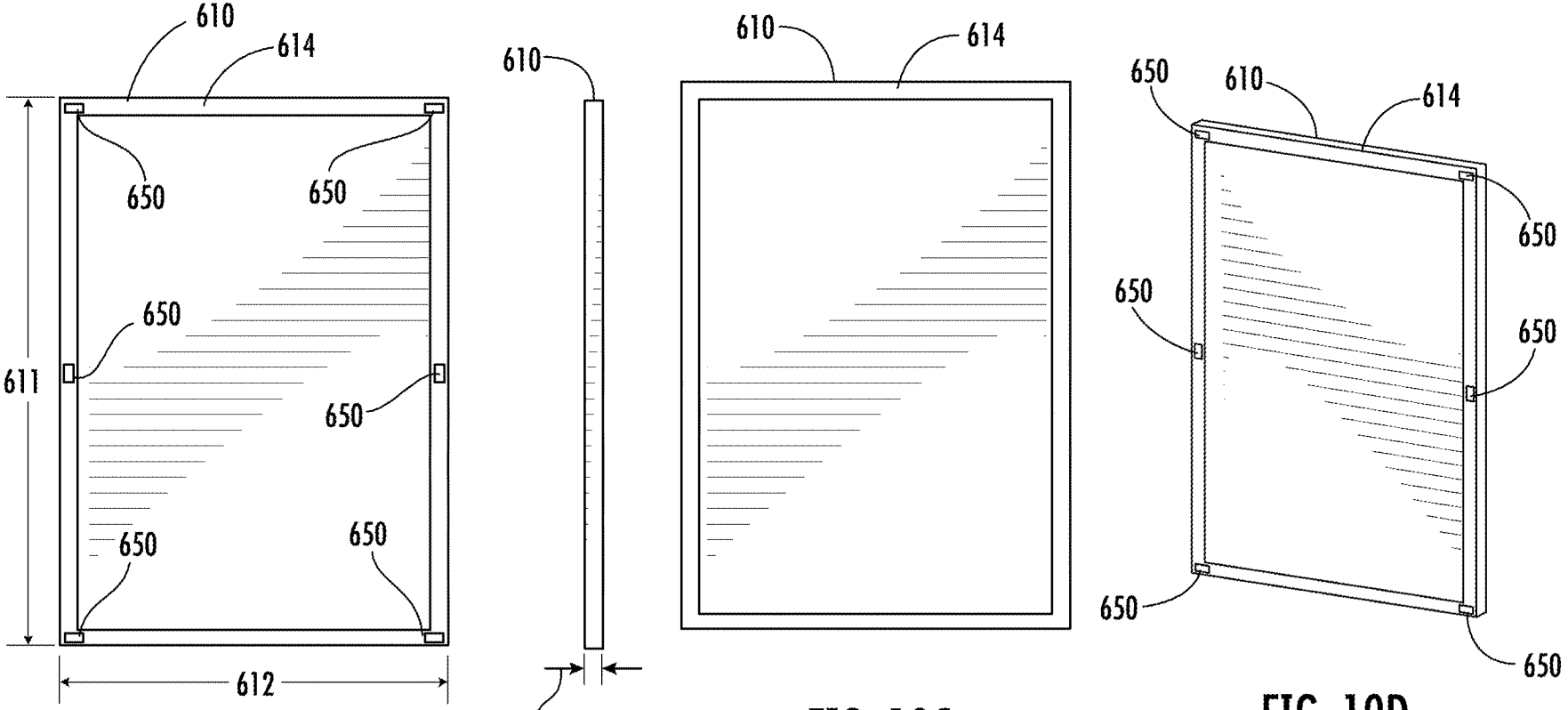
FIG. 10A is a front view of a sound attenuation panel, according to an example embodiment of the present disclosure.
FIG. 10B is a side view of a sound attenuation panel, according to an example embodiment of the present disclosure.
FIG. 10C is a rear view of a sound attenuation panel, according to an example embodiment of the present disclosure.
FIG. 10D is an angled view of a sound attenuation panel, according to an example embodiment of the present disclosure.

FIGS. 10A-D show an illustration of a first sound attenuation panel 610 that may be used according to an embodiment of the present disclosure. In some embodiments, the first sound attenuation panel 610 is the same or similar to the front sound attenuation panel 505 discussed in connection with FIG. 6. FIG. 10A shows a front view of the sound attenuation panel 610. In some embodiments, this front side is configured to couple to the interior of a replacement cover and/or an existing wall of an HVAC device. In the depicted embodiment, the panel has a rectangular shape and includes a length 611, a width 612, and a thickness 613. It also includes a frame 614 bordering the panel. The depicted embodiment includes magnets 650, which may be used to couple the panel to the wall or structure of an HVAC device. FIG. 10B shows the side of the first sound attenuation panel 610, and in the depicted embodiment, the thickness is substantially constant. FIG. 10C shows the rear view of the first sound attenuation panel 610 of this embodiment, and in some embodiments, this side of the sound attenuation panel 610 is configured to be facing the interior space of an HVAC chamber, potentially the interior space of a combustion air chamber of a furnace. FIG. 10D shows an angled view of this panel according to an embodiment of this disclosure.

In the depicted embodiment, first sound attenuation panel 610 is shaped to mirror the enlarged region 640 of the replacement cover 605 and is sized such that it is the same or smaller than the enlarged region 640. In the depicted embodiment, the length 611 of the sound attenuation panel 610 is equal to or less than the length 642 of the enlarged region 640. The width 612 of the sound attenuation panel 610 is equal to or less than the width 641 of enlarged region 640. The thickness 613 of the sound attenuation panel 610 is equal to or less than the depth of the enlargement panel 643. Other embodiments may include different dimensions or shapes associated with the first sound attenuation panel 610. For example, in some embodiments, the first sound attenuation panel may be smaller in length or width than the replacement cover, which in some embodiments, is configured to form a discontinuous section. In some embodiments, the first sound attenuation panel includes openings within the panel to create discontinuous sections in that manner. In some embodiments, the sound attenuation panel extends beyond the replacement cover, potentially to attenuate sound from additional components. In some embodiments, the sound attenuation panel is thicker than the depth of the enlarged space. In some embodiments, the first sound attenuation panel couples to an existing panel of an HVAC device. Additional dimensions and shapes for the first sound attenuation panel are contemplated within the scope of this disclosure.

In the depicted embodiment, the first sound attenuation panel 610 has a substantially constant thickness throughout. In this embodiment, the sound attenuation panel 610 includes acoustic metamaterial comprising a double stacked configuration as shown in FIGS. 5A and 5B. In the embodiment depicted in FIGS. 10A-D, the first sound attenuation panel 610 includes a double stacked configuration for the entire length and width of the panel. In some embodiments, the sound attenuation panel includes portions that have different acoustic metamaterial structures. For example, some embodiments may include a first portion that comprises acoustic metamaterial with a single stacked structure and a second portion with a double stacked structure. Other embodiments may include either a different number of portions with varying stacked configurations and/or more or less stacking structures. Different acoustic metamaterial configurations and structures are contemplated within the scope of this disclosure.

In the depicted embodiment, the first sound attenuation panel 610 includes multiple magnets 650 embedded within the frame of the panel. In some embodiments, these magnets enable the first sound attenuation panel 610 to couple to the replacement cover and/or given wall or structure of an HVAC device. In some embodiments, these magnets are located on one side of the panel and are configured to ensure the panel is located properly. For example, in the depicted embodiment, the magnets 650 are located on a front side of the panel, potentially a first side, and ensure that the front side is facing the replacement cover. In some embodiments, this configuration aligns the sound attenuation layers in a given direction. In some embodiments, this configuration aligns the panel and/or panel features appropriately relative to the HVAC device. In the depicted embodiment, magnets extend into the sound attenuation panel. In some embodiments, the magnets extend all the way through the sound attenuation panel. Some embodiments include other fastening devices, e.g., screws, nails, hook and loop fasteners, etc., which may be used to attach these panels. Other magnetic configurations, fasteners, and attachment configures are contemplated within the scope of the present disclosure.

Figure 11D:
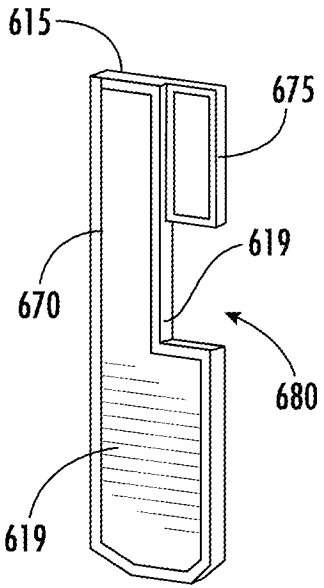
FIG. 11D is an angled view of a sound attenuation panel, according to an example embodiment of the present disclosure.
Figure 11C:
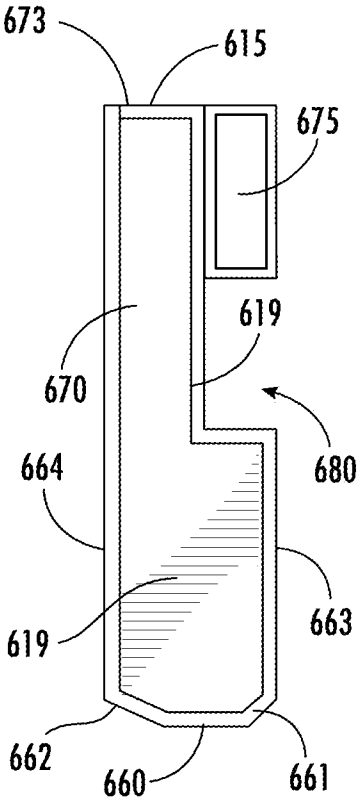
FIG. 11C is a rear view of a sound attenuation panel, according to an example embodiment of the present disclosure.
Figure 11B:
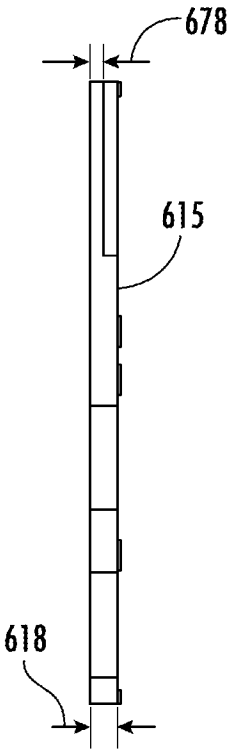
FIG. 11B is a side view of a sound attenuation panel, according to an example embodiment of the present disclosure.
Figure 11A:
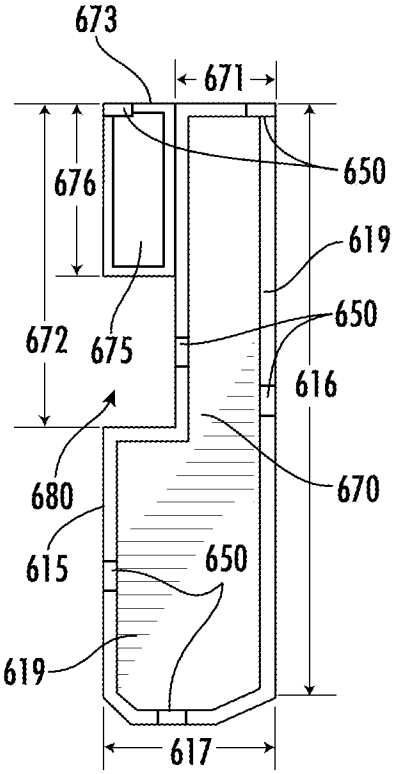
FIG. 11A is a front view of a sound attenuation panel, according to an example embodiment of the present disclosure.

FIGS. 11A-D show an illustration of a second sound attenuation panel 615 that may be used according to an embodiment of the present disclosure. In some embodiments, the second sound attenuation panel 615 is the same or similar to the side sound attenuation panel 515 discussed in connection with FIG. 6. FIG. 11A shows a front view of the sound attenuation panel 615. In some embodiments, this front side is configured to couple to the interior of a replacement cover and/or an existing wall of an HVAC device. In the depicted embodiment, the panel has a generally rectangular shape with various additional features and includes a length 616, a width 617, and a thickness 618. It also includes a frame 619 bordering the panel as well as magnets 650 at various locations on the panel, which may be used to couple the panel to the wall or structure of an HVAC device. FIG. 11B shows a side view of second sound attenuation panel 615 for this embodiment. FIG. 11C shows the rear view of the second sound attenuation panel 615 of this embodiment, and in some embodiments, this rear side may be configured to face the interior of an HVAC device. FIG. 11D shows an angled view of this panel according to an embodiment of this disclosure.

In the depicted embodiment, second sound attenuation panel 615 is shaped to couple to a side combustion air wall panel 310, potentially the right side when facing the front panel of combustion air chamber 125. In the depicted embodiment, the second sound attenuation panel 615 is generally rectangular shaped with various features. In the depicted embodiment, the length 616 of the second sound attenuation panel 615 is sized such that it is less than the length of the side combustion air wall panel 310, and in this embodiment, this is done to allow for a discontinuous section to be located on the side combustion air wall panel 310. In the depicted embodiment, the width 617 of the second sound attenuation panel 615 is sized such that it is the same or less than the width of the side combustion air wall panel 310.

In the depicted embodiment, second sound attenuation panel 615 includes additional features. For example, in the depicted embodiment, the bottom edge 660 includes chamfered edges 661 and 662, which angle the bottom edge 660 to the side edges 663 and 664. In the depicted embodiment, the chamfered edge 661 creates a steeper angle than the chamfered edge 662. In some embodiments, these chamfered edges are reversed, such that edge 662 creates a steeper angle than other chamfered edge 661. In some embodiments, these chamfered edges create an equivalent angle. In some embodiments, these chamfered edges are designed to match features on the side combustion air panel. In some embodiments, the chamfered edges are designed to account for adjustments or damage that may have changed the dimensions of the side combustion air chamber. In some embodiments, the chamfered edges account for retrofit application of the second sound attenuation panel 615 into an existing HVAC system. In some embodiments, the chamfered edges create discontinuation sections. The depicted embodiment includes two chamfered edges, and some embodiments include more or less of these edges, or none at all.

The depicted embodiment also includes an elongated portion 670 where a narrower portion of the panel extends for a portion of the panel length or width. In the depicted embodiment, the elongated portion 670 includes a width 671 that is narrower than the overall width of the panel 617. In the depicted embodiment, the elongated portion 670 extends directly on one side of the panel 615. In some embodiments, the elongated portion extends at an angle and/or from the middle of the panel width. Some embodiments may include multiple elongated portions and/or the elongated portion may vary in direction and/or dimension. In some embodiments, the elongated portion is designed to account for components or features that may be located on or adjacent to the side combustion air panel 310.

In the depicted embodiment, second sound attenuation panel 615 also includes an extended portion 675 that extends from the elongated portion 670. In the depicted embodiment, the extended portion 675 extends from the top edge 673 of the second sound attenuation panel 615 and extends a length 676 that is a portion of the length of the elongated portion 672. In the depicted embodiment, the thickness 678 of the extended portion 675 is narrower than the thickness 618 of the second sound attenuation panel 615. This can be seen in FIG. 11B, and in the depicted embodiment, the thickness 678 of the extended portion 675 is approximately half the thickness 618 of the second sound attenuation panel 615. In some embodiments, the thickness 678 of the extended portion 675 is the same as the thickness 618 of the sound side attenuation panel 615. In some embodiments, the thickness 678 of the extended portion 675 is greater than the thickness 618 of the majority of the sound side attenuation panel 615. In the depicted embodiment, this configuration creates a notch 680 along one side of second sound attenuation panel 615, and this notch 680 may comprise a discontinuous section. In some embodiments, the extended portion 675 extends at an angle and/or from the middle of the elongated portion 670. Some embodiments may include multiple extended portions and/or the extended portion may vary in direction and/or dimension. In some embodiments, the extended portion is designed to account for components or features that may be located on or adjacent to the side sound attenuation panel 305.

Other embodiments may include different dimensions or shapes associated with the second sound attenuation panel 615. For example, in some embodiments, the side sound attenuation panel may span the entire length and/or width of the side combustion air wall panel, which in some embodiments, is configured to remove the discontinuous section. In some embodiments, the second sound attenuation panel 615 includes openings within the panel to create discontinuous sections in that manner. In some embodiments, the side sound attenuation panel extends beyond the side combustion air wall panel, potentially to attenuate sound from additional components. Additional dimensions and shapes for the side sound attenuation panel are contemplated within the scope of the disclosure.

In the depicted embodiment, the second sound attenuation panel 615 includes acoustic metamaterial comprising a double stacked configuration as shown in FIGS. 5A and 5B for at least a portion of the second sound attenuation panel 615. In the depicted embodiment, second sound attenuation panel 615 varies in thickness. In this embodiment, second sound attenuation panel 615 includes a first portion that comprises an acoustic metamaterial layer configured in a singled stacked structure and a second portion that comprises a double stacked structure. In the depicted embodiment, extended portion 675 comprises an acoustic metamaterial layer in the single stacked configuration, such that the first portion comprises a first perforated sheet layer arranged over a spacer layer arranged over a second perforated sheet layer. In the depicted embodiment, the main portion 619 of the second sound attenuation panel 615 and the elongated portion 670 of the second sound attenuation panel 615 comprise a double stacked structure where a third perforated layer is arranged over a second spacer layer that is arranged over the stacked structure. As shown in the depicted embodiment, the width of the extended portion 675 is half the width of the main portion 619 and the elongated portion 670 because the extended portion comprises a single stack configuration for the acoustic metamaterial layer and the other portions comprise a double stack configuration. Some embodiments comprise a double stacked configuration for the entire length and width of the panel. Other embodiments may include either a different number of portions with varying stacked configurations and/or more or less stacking structures. Different acoustic metamaterial configurations and structures are contemplated within the scope of this disclosure.

In the depicted embodiment, the second sound attenuation panel 615 includes multiple magnets 650 embedded around the panel. In some embodiments, these magnets 650 enable the second sound attenuation panel 615 to couple to side combustion air wall panel 310 and/or a given wall or structure of an HVAC device. In some embodiments, these magnets are located on one side of the panel and are configured to ensure the panel is located properly. For example, in the depicted embodiment, the magnets 650 are located on a front side of the panel, potentially a first side, and ensure that side is facing the HVAC device wall panel. In some embodiments, this configuration aligns the sound attenuation layers in a given direction. In some embodiments, this configuration aligns the panel and/or panel features appropriately relative to the HVAC device. In the depicted embodiment, magnets extend into the sound attenuation panel. Some embodiments include other fastening devices, e.g., screws, nails, etc., which may be used to attach these panels. Other magnetic configurations, fasteners, and attachment configures are contemplated within the scope of the present disclosure.

Figure 12D:
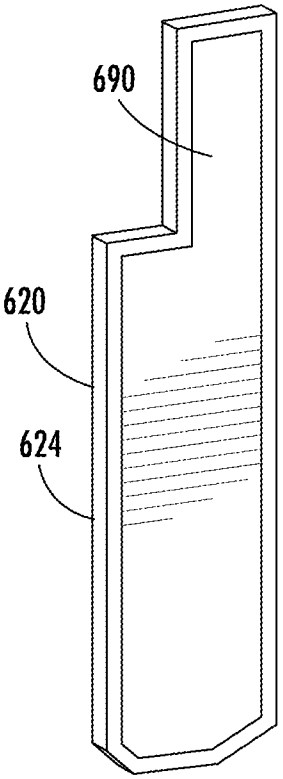
FIG. 12D is an angled view of a sound attenuation panel, according to an example embodiment of the present disclosure.
Figure 12C:
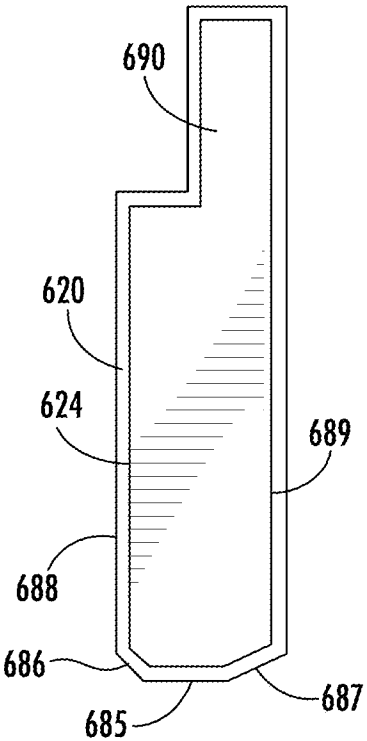
FIG. 12C is a rear view of a sound attenuation panel, according to an example embodiment of the present disclosure.
Figure 12B:
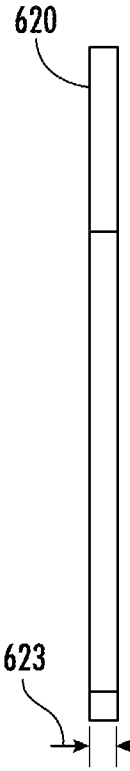
FIG. 12B is a side view of a sound attenuation panel, according to an example embodiment of the present disclosure.
Figure 12A:
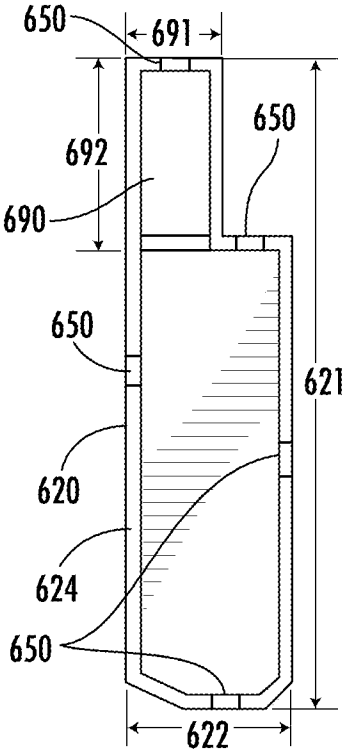
FIG. 12A is a front view of a sound attenuation panel, according to an example embodiment of the present disclosure.

FIGS. 12A-D show an illustration of the third sound attenuation panel 620 that may be used according to an embodiment of the present disclosure. In some embodiments, the third sound attenuation panel 620 is the same or similar to the side sound attenuation panel 510 discussed in connection with FIG. 6. FIG. 12A shows a front view of the third sound attenuation panel 620. In some embodiments, this front side is configured to couple to the interior of a replacement cover and/or an existing wall of an HVAC device. In the depicted embodiment, the panel has a rectangular shape with various additional features and includes a length 621, a width 622, and a thickness 623. It also includes a frame 619 bordering the panel as well as magnets 650 at various locations on the panel, which may be used to couple the panel to the wall or structure of an HVAC device. FIG. 12B shows a side view and the thickness 623 of the third sound attenuation panel 620, which in the depicted embodiment is substantially constant. FIG. 12C shows the rear view of the third sound attenuation panel 620 of this embodiment, and in some embodiments, this rear side may be configured to face the interior of an HVAC device. FIG. 12D shows an angled view of this panel according to an embodiment of this disclosure.

In the depicted embodiment, third sound attenuation panel 620 is shaped to couple to a side combustion air wall panel 310, potentially the left side when facing the front panel of combustion air chamber 125. In the depicted embodiment, the third sound attenuation panel 620 is generally rectangular shaped with various features. In the depicted embodiment, the width 622 of the third sound attenuation panel 620 is sized such that it is the same or smaller than the width of the side combustion air wall panel 310. In the depicted embodiment, the length 621 of the third sound attenuation panel 620 is sized such that is smaller than the length of the side combustion air wall panel 310.

In the depicted embodiment, third sound attenuation panel 620 includes additional features. For example, in the depicted embodiment, the bottom edge 685 includes chamfered edges 686 and 687, which angle the bottom edge 685 to the side edges 688 and 689. In the depicted embodiment, the chamfered edge 686 creates a steeper angle than the chamfered edge 687. In some embodiments, these chamfered edges are reversed, such that edge 687 creates a steeper angle than the other chamfered edge 686. In some embodiments, these chamfered edges create an equivalent angle. In some embodiments, these chamfered edges are designed to match features on the side combustion air panel. In some embodiments, the chamfered edges are designed to account for adjustments or damage that may have changed the dimensions of the combustion air chamber. In some embodiments, the chamfered edges create discontinuation sections. The depicted embodiment includes two chamfered edges, and some embodiments include more or less of these edges, or none at all.

The depicted embodiment also includes an elongated portion 690 where a narrower portion of the panel extends for a portion of the panel length or width. In the depicted embodiment, the elongated portion 690 includes a width 691 that is narrower than the overall width 622 of the panel 620. In the depicted embodiment, the elongated portion 690 extends directly along one side of the panel 620. In some embodiments, the elongated portion extends at an angle and/or from the middle of the width. Some embodiments may include multiple elongated portions and/or the elongated portion may vary in shape, directions, and/or dimensions. In some embodiments, the elongated portion is designed to account for components or features that may be located on or adjacent to the side combustion air panel 305.

Other embodiments may include different dimensions or shapes associated with the third sound attenuation panel 620. For example, in some embodiments, the side sound attenuation panel may span the entire length and/or width of the side combustion air wall panel, which in some embodiments, is configured to remove the discontinuous section. In some embodiments, the third sound attenuation panel 620 includes openings within the panel to create discontinuous sections in that manner. In some embodiments, the sound attenuation panel extends beyond the side combustion air wall panel, potentially to attenuate sound from additional components. Additional dimensions and shapes for the side sound attenuation panel are contemplated within the scope of the disclosure.

In the depicted embodiment, the third sound attenuation panel 620 has a substantially constant thickness throughout. In this embodiment, the third sound attenuation panel 620 includes acoustic metamaterial comprising a double stacked configuration as shown in FIGS. 5A and 5B. In the embodiment depicted in FIGS. 12A-D, the third sound attenuation panel 620 includes a double stacked configuration for the entire length and width of the panel. In some embodiments, the sound attenuation panel includes portions that have different acoustic metamaterial structures. For example, some embodiments may include a first portion that comprises acoustic metamaterial with a single stacked structure and a second portion with a double stacked structure. Other embodiments may include either a different number of portions with varying stacked configurations and/or more or less stacking structures. Different acoustic metamaterial configurations and structures are contemplated within the scope of this disclosure.

In the depicted embodiment, the third sound attenuation panel 620 includes multiple magnets 650 embedded around the panel. In some embodiments, these magnets 650 enable the sound attenuation panel 620 to couple to side combustion air wall 310 and/or a given wall or structure of an HVAC device. In some embodiments, these magnets are located on one side of the third sound attenuation panel and are configured to ensure the third sound attenuation panel is located properly. For example, in the depicted embodiment, the magnets 650 are located on a front side of the third sound attenuation panel, potentially a first side, and ensure that side is facing the HVAC wall panel appropriately. In some embodiments, this configuration aligns the sound attenuation layers in a given direction. In some embodiments, this configuration aligns the third sound attenuation panel and/or third sound attenuation panel features appropriately relative to the HVAC device. In the depicted embodiment, magnets extend into the sound attenuation panel. Other magnetic configurations, fasteners, and attachment configures are contemplated within the scope of the present disclosure.

Figure 13B:
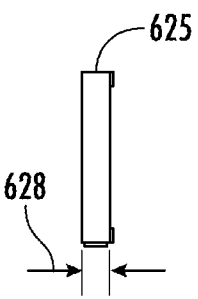
FIG. 13B is a side view of a sound attenuation panel, according to an example embodiment of the present disclosure.
Figure 13A:
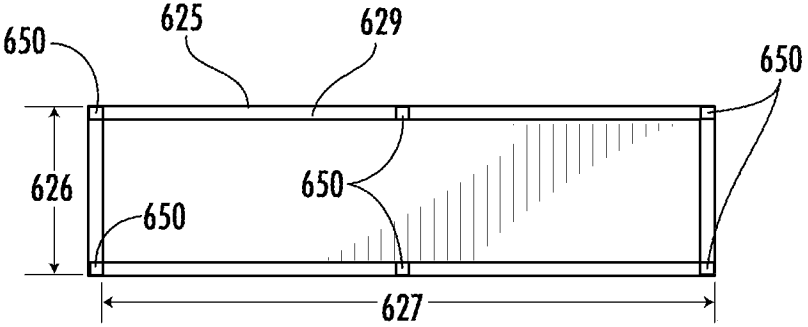
FIG. 13A is a front view of a sound attenuation panel, according to an example embodiment of the present disclosure.
Figure 13D:
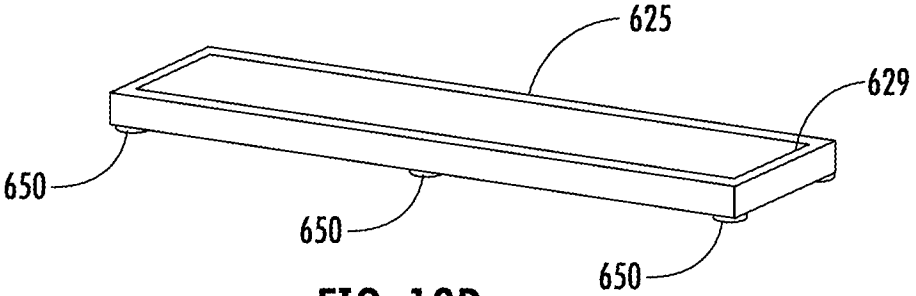
FIG. 13D is an angled view of a sound attenuation panel, according to an example embodiment of the present disclosure.
Figure 13C:
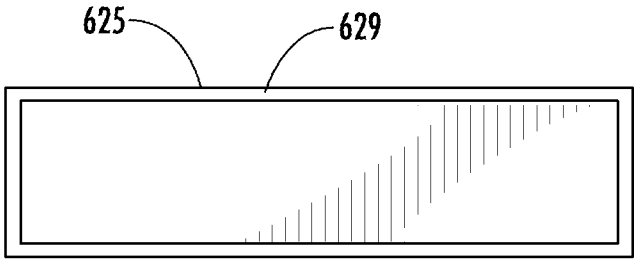
FIG. 13C is a rear view of a sound attenuation panel, according to an example embodiment of the present disclosure.

FIGS. 13A-D show an illustration of a fourth sound attenuation panel 625 that may be used according to an embodiment of the present disclosure. In some embodiments, the fourth sound attenuation panel 625 is the same or similar to the bottom sound attenuation panel 520 discussed in connection with FIG. 6. In the depicted embodiment, the panel has a rectangular shape and includes a length 626, a width 627, and a thickness 628. It also includes a frame 629 bordering the panel. The depicted embodiment includes magnets 650, which may be used to couple the panel to the wall or structure of an HVAC device. FIG. 13B shows a side view and the thickness 628 of the fourth sound attenuation panel 625, and in the depicted embodiment, the thickness is substantially constant. FIG. 13C shows the rear view of the fourth sound attenuation panel 625 of this embodiment, and in some embodiments, this side of the sound attenuation panel 625 is configured to be facing the interior space of an HVAC chamber, potentially the interior space of a combustion air chamber of a furnace. FIG. 13D shows an angled view of this panel according to an embodiment of this disclosure.

In the depicted embodiment, fourth sound attenuation panel 625 is shaped to mirror the bottom combustion air wall panel 325 and is sized such that it is the same or smaller than the bottom combustion air wall panel 325. The fourth sound attenuation panel 625 is shaped such that it mirrors the bottom combustion air wall panel 325. In the depicted embodiment, the length 626 of the sound attenuation panel 625 is equal to or less than the length of the bottom combustion air wall panel 325. The width 627 of the sound attenuation panel 625 is equal to or less than the width of bottom combustion air wall panel 325. Other embodiments may include different dimensions or shapes associated with the fourth sound attenuation panel 625. For example, in some embodiments, the fourth sound attenuation panel may be smaller in length or width than the bottom combustion air panel, which in some embodiments, is configured to form a discontinuous section. In some embodiments, the fourth sound attenuation panel includes openings within the panel to create discontinuous sections in that manner. In some embodiments, the fourth sound attenuation panel extends beyond the bottom combustion air panel, potentially to attenuate sound from additional components. Additional dimensions and shapes for the fourth sound attenuation panel are contemplated within the scope of the disclosure.

In the depicted embodiment, the fourth sound attenuation panel 625 has a substantially constant thickness throughout. In this embodiment, the fourth sound attenuation panel 625 includes acoustic metamaterial comprising a double stacked configuration as shown in FIGS. 5A and 5B. In the embodiment depicted in FIGS. 13A-D, the fourth sound attenuation panel 625 includes a double stacked configuration for the entire length and width of the panel. In some embodiments, the fourth sound attenuation panel includes portions that have different acoustic metamaterial structures. For example, some embodiments may include a first portion that comprises acoustic metamaterial with a single stacked structure and a second portion with a double stacked structure. Other embodiments may include either a different number of portions with varying stacked configurations and/or more or less stacking structures. Different acoustic metamaterial configurations and structures are contemplated within the scope of this disclosure.

In the depicted embodiment, the fourth sound attenuation panel 625 includes multiple magnets embedded within each corner of the panel. In some embodiments, these magnets enable the fourth sound attenuation panel 625 to couple to bottom combustion air wall panel 325 and/or given wall or structure of an HVAC device. In some embodiments, these magnets are located on one side of the panel and are configured to ensure the panel is located properly. For example, in the depicted embodiment, the magnets 650 are located on a front side of the panel, potentially a first side, and ensure that side is facing the HVAC wall appropriately. In some embodiments, this configuration aligns the sound attenuation layers in a given direction. In some embodiments, this configuration aligns the panel and/or panel features appropriately relative to the HVAC device. In the depicted embodiment, magnets extend into the sound attenuation panel. Some embodiments include other fastening devices, e.g., screws, nails, etc., which may be used to attach these panels. Other magnetic configurations, fasteners, and attachment configures are contemplated within the scope of the present disclosure.

The sound attenuation panels discussed in connection with FIGS. 10-13 are illustrative embodiments of sound attenuation panels that may be used according to the present disclosure. The various features and configurations discussed in these embodiments are equally applicable to each other and/or other sound attenuation panels.

Figure 14A:
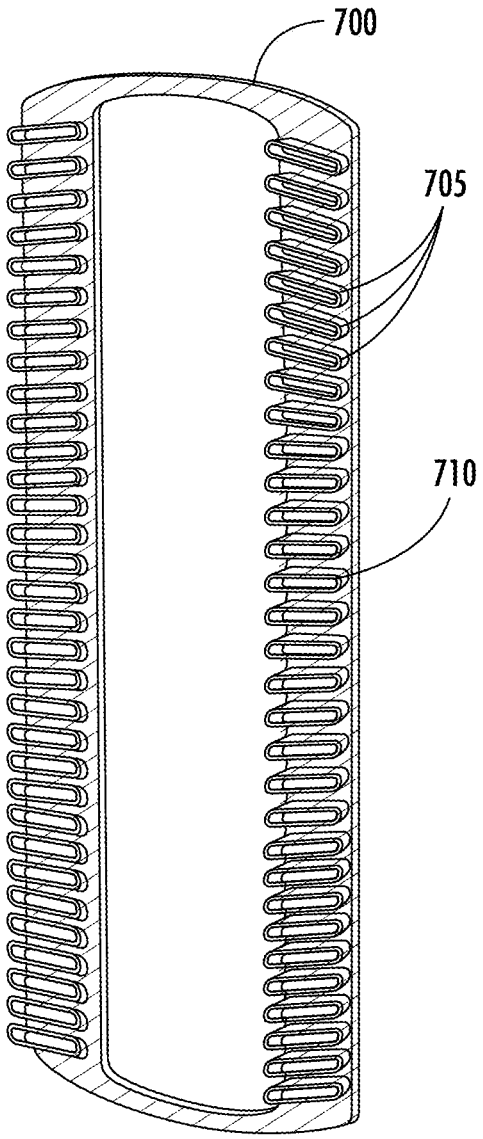
FIG. 14A is an angled front view of a sound attenuation panel with sound attenuation protrusions, according to an example embodiment of the present disclosure.
Figure 14B:
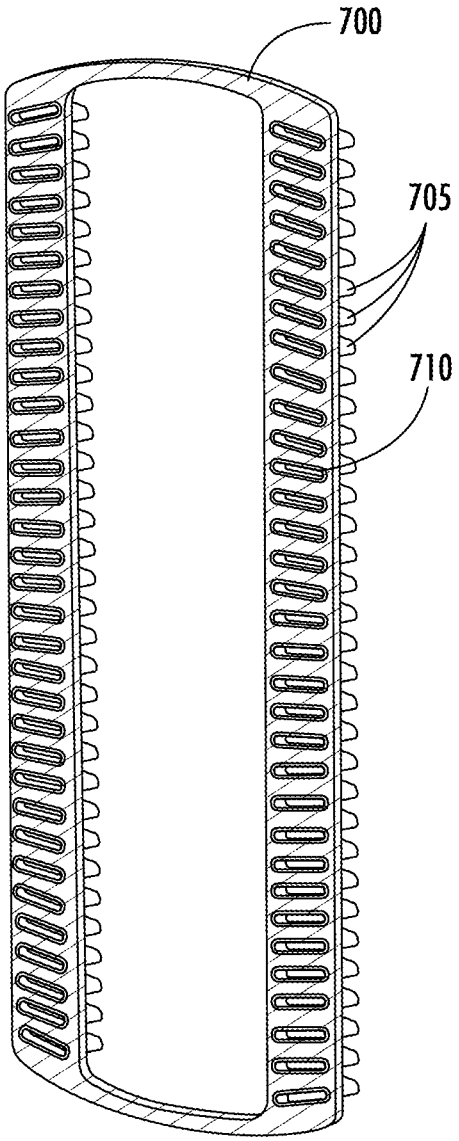
FIG. 14B is an angled rear view of a sound attenuation panel with sound attenuation protrusions according to an example embodiment of the present disclosure.
Figure 14C:
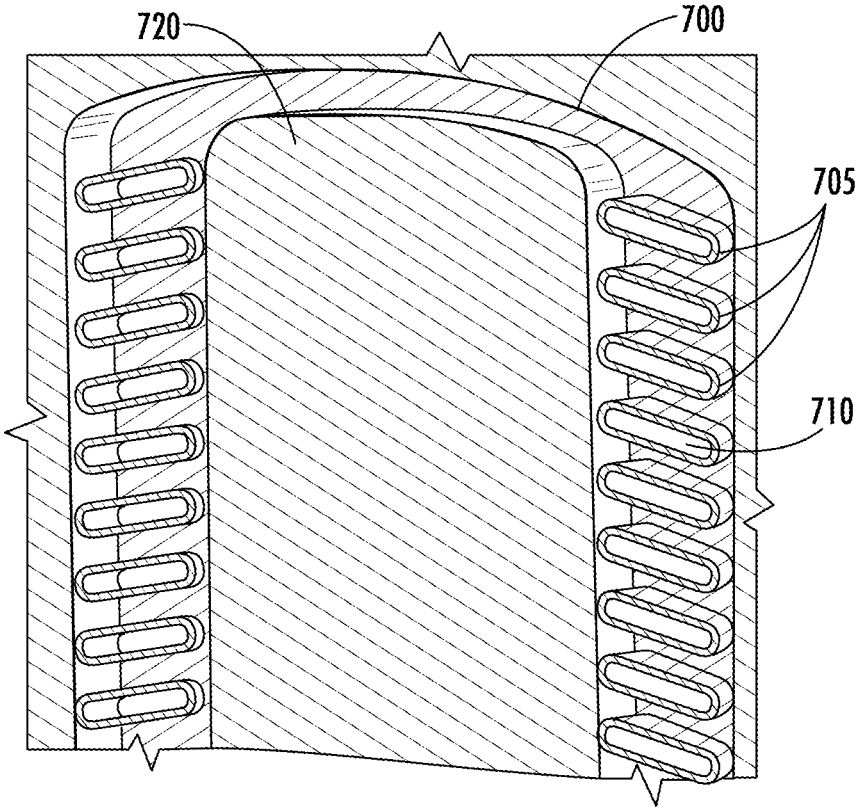
FIG. 14C is an angled view of a portion of a sound attenuation panel with sound attenuation protrusions, according to an example embodiment of the present disclosure.

FIGS. 14A-D show illustrations of various sound attenuation protrusions which may be used in some embodiments. In the depicted embodiment, FIG. 14A shows a front view of a sound attenuation layer 700 that includes multiple sound attenuation protrusions 705. FIG. 14B shows an illustration of a rear view of this sound attenuation layer 700. FIG. 14C shows an enlarged illustration of a portion of the sound attenuation layer 700 and the sound attenuation protrusions 705 located on a portion of the front panel of an HVAC device, potentially the front panel of the combustion furnace shown in FIG. 4A.

In the depicted embodiment, the sound attenuation protrusions 705 extend from the sound attenuation layer 700 and are shaped to create apertures 710 within the sound attenuation layer 700. In the depicted embodiment, the apertures 710 are all consistently shaped, and in this embodiment, these apertures 710 are designed to match the openings 715 located on the front the combustion air panel 720. In some embodiments, the apertures 710 are designed to match other openings within an HVAC device, and these apertures 710 may vary in size and shape. In some embodiments of these sound attenuation protrusions 705 may include a single aperture 710, and some embodiments they are not configured to match an opening on an HVAC device. For example, these apertures may be larger or smaller than a given opening, or they may be located on a portion of the housing that does not include an opening, e.g., the aperture (s) 710 may align with a thermal bridge, communication pathway, etc.

Figure 14D:
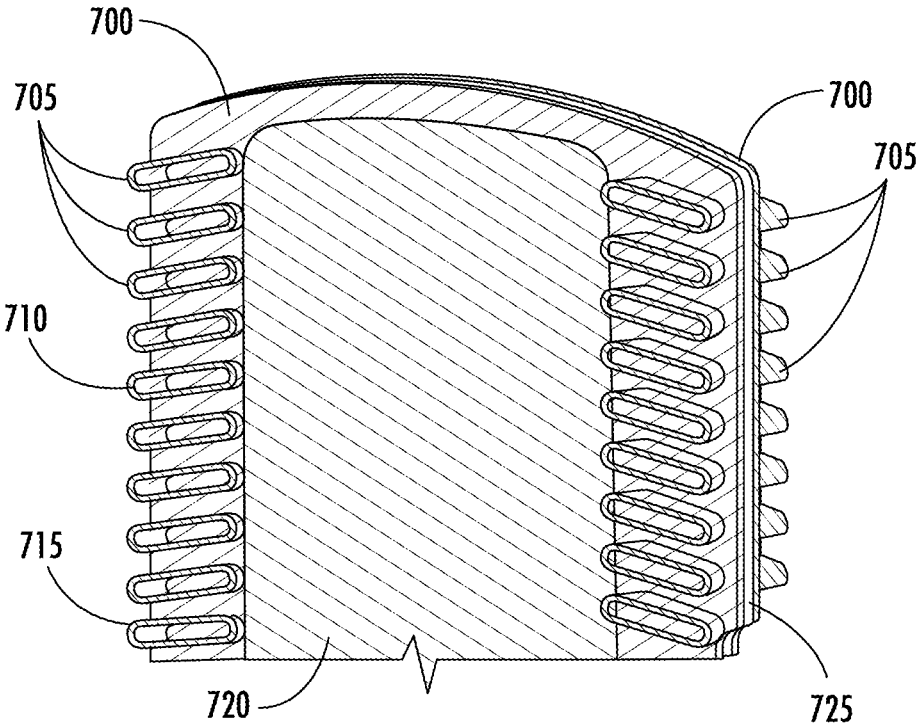
FIG. 14D is an angled view of a portion of a sound attenuation panel with sound attenuation protrusions on a portion of a housing, according to an example embodiment of the present disclosure.

FIG. 14D shows an embodiment that includes two sound attenuation layers 700, each with sound attenuation protrusions 705. In the depicted embodiment, these layers and protrusions match each other and are coupled to either side of the housing openings. FIG. 14D shows these two layers spaced a distance 725 apart.

In the depicted embodiment, the sound attenuation protrusions 705 extend a distance from the sound attenuation layer 700, and in the depicted embodiment, the sound attenuation protrusions 705 extend the same distance. In some embodiments, the distance these protrusions extend is greater or lesser, and in some embodiments the distance varies. In the depicted embodiment, the sound attenuation protrusions 705 extend from a discrete layer 700. In some embodiments, sound attenuation protrusions 705 may extend from any of the sound attenuation layers and/or panels discussed above. In some embodiments, the sound attenuation protrusions extend independently and are not associated with another sound attenuation layer.

In the depicted embodiment, the sound attenuation layer 700 and the sound attenuation protrusions 705 are formed from the same material. In some embodiments, the sound attenuation layer 700 and the sound attenuation protrusions 705 are formed from acoustic metamaterial. In some embodiments, the sound attenuation layer 700 and the sound attenuation protrusions 705 are formed from different material. In some embodiments, the sound attenuation protrusions are formed form plastic, metal, or other material. In some embodiments, where either the sound attenuation layer 700 or the sound attenuation protrusions 705 are composed of an acoustic metamaterial the acoustic metamaterial is tuned to attenuate sound at a frequency band that covers the frequency of operation for a given sound producing component within an HVAC device. In embodiments that include multiple sound attenuation layers comprising acoustic metamaterial, the acoustic metamaterial included in the sound attenuation layer 700 and/or the sound attenuation protrusions 705 is tuned to attenuate frequency from the same frequency band as one or more of the other sound attenuation layer(s). In other embodiments, acoustic metamaterial included in the sound attenuation layer 700 and/or the sound attenuation protrusions 705 is tuned to attenuate sound from a different band as one or more of the other sound attenuation layer(s).

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. An improved furnace comprising:

a housing comprising a combustion air chamber, a heat exchanger chamber, and a circulation blower chamber, wherein the combustion air chamber comprises a burner assembly and a combustion air fan;

a sound attenuation layer comprising an acoustic metamaterial layer tuned to attenuate sound for a frequency band, wherein the frequency band includes a frequency of operation of at least one of the burner assembly and the combustion air fan, and wherein the sound attenuation layer is coupled to a portion of the combustion air chamber; and one or more housing openings fluidly connecting the combustion air chamber to an environment outside the housing, wherein each of the one or more housing openings provides less attenuation of sound emanating from within the combustion air chamber than the housing, wherein the sound attenuation layer includes a discontinuous section that aligns with one or more of the housing openings.

2. The improved furnace of claim 1, wherein the frequency band includes a range of 400 Hz to 500 Hz.

3. The improved furnace of claim 1, wherein the acoustic metamaterial layer comprises a first stacked structured, the first stacked structure including a first perforated sheet layer arranged over a spacer layer arranged over a second perforated sheet layer.

4. The improved furnace of claim 3, wherein the first and second perforated sheet layers comprise plastic.

5. The improved furnace of claim 4, wherein the first, second, and third perforated sheets are each tuned to attenuate sound for the frequency band.

6. The improved furnace of claim 4, wherein the frequency band is a first frequency band, and wherein the first and second perforated sheets are each tuned to attenuate sound for the first frequency band, and the third perforated sheet is tuned to attenuate sound for second frequency band, the second frequency band being different from the first frequency band.

7. The improved furnace of claim 3, wherein the sound attenuation layer comprises a first portion wherein the acoustic metamaterial layer comprises the first stacked structure and a second portion wherein the acoustic metamaterial layer comprises a second double stacked structure, wherein the second double stacked structure includes a third perforated sheet layer arranged over a second spacer layer arranged over the first stacked structure.

8. The improved furnace of claim 1, wherein at least one of the housing openings further comprises a plurality of apertures, wherein the sound attenuation layer further comprises a first set of sound attenuation protrusions located around the plurality of apertures.

9. The improved furnace of claim 8, wherein the first set of sound attenuation protrusions comprise acoustic metamaterial.

10. The improved furnace of claim 1, wherein the combustion air chamber comprises a front door having an enlarged region, wherein at least a portion of the acoustic metamaterial layer is coupled within the enlarged region.

11. A retrofit kit for reducing low frequency sound emanating from an HVAC device having a housing, wherein the HVAC device comprises a gas-fired furnace comprising a combustion chamber, wherein the combustion chamber comprises a burner assembly and a combustion air fan, the retrofit kit comprising:

a plurality of sound attenuation panels, each panel comprising at least one acoustic metamaterial layer tuned to attenuate sound for a frequency band, wherein the at least one acoustic metamaterial layer comprises a first stacked structure, wherein the first stacked structure comprises a first perforated sheet layer arranged over a spacer layer arranged over a second perforated sheet layer; and a replacement cover configured to replace an existing panel of the housing of the HVAC device, wherein the sound attenuation panels are configured to couple to a portion of the housing of the HVAC device, and at least one sound attenuation panel is configured to couple to the replacement cover, wherein the sound attenuation panels are configured to form a discontinuous section on a portion of the housing, wherein the discontinuous section is configured to be aligned with one or more openings in the HVAC device housing, and wherein the frequency band includes the frequency of operation of at least one of the burner assembly and the combustion air fan.

12. The retrofit kit of claim 11, wherein the replacement cover comprises an enlarged region.

13. The retrofit kit of claim 11, wherein the enlarged region is equal to or greater than the size of the at least one sound attenuation panel configured to couple to the replacement cover.

14. The retrofit kit of claim 11, wherein the frequency band includes a range of 400 Hz to 500 Hz.

15. The retrofit kit of claim 11, wherein at least one of the sound attenuation panels comprises a first portion where the acoustic metamaterial layer comprises the first stacked structure and a second portion that comprise a second double stacked structure, wherein the second double stacked structure comprises a third perforated sheet layer arranged over a second spacer layer arranged over the first stacked structure.

16. The retrofit kit of claim 15, wherein the first, second, and third perforated sheets are each tuned to attenuate sound for the frequency band.

17. The retrofit kit of claim 11, wherein at least one sound attenuation panel of the plurality of sound attenuation panels includes a chamfered edge.

18. The retrofit kit of claim 11, wherein at least one of the sound attenuation panels of the plurality of sound attenuation panels includes a notch.

19. The retrofit kit of claim 11, wherein at least one of the sound attenuation panels of the plurality of sound attenuation panels comprises magnets on a first side of the sound attenuation panels of the plurality of sound attenuation panels, wherein the magnets are configured to couple the sound attenuation panel to the housing at a given orientation.

* * * * *